US007139011B2

(12) United States Patent
Igi et al.

(10) Patent No.: US 7,139,011 B2
(45) Date of Patent: Nov. 21, 2006

(54) INK SHEET CARTRIDGE AND EXCHANGEABLE INK SHEET SET

(75) Inventors: Hisashi Igi, Nagoya (JP); Toshiaki Ando, Gamou-gun (JP); Takashi Kobayashi, Otsu (JP)

(73) Assignees: Brother Kogyo Kabushiki Kaisha, Nagoya (JP); General Co., Ltd., Osaka (JP)

( * ) Notice: Subject to any disclaimer, the term of this patent is extended or adjusted under 35 U.S.C. 154(b) by 154 days.

(21) Appl. No.: 10/939,387

(22) Filed: Sep. 14, 2004

(65) Prior Publication Data

US 2005/0068409 A1 Mar. 31, 2005

(30) Foreign Application Priority Data

Sep. 30, 2003 (JP) ..... 2003-341372

(51) Int. Cl.
*B41J 32/00* (2006.01)

(52) U.S. Cl. ..... 347/214; 400/208.1

(58) Field of Classification Search ..... 347/214; 400/208, 208.1, 242, 246
See application file for complete search history.

(56) References Cited

U.S. PATENT DOCUMENTS 5,248,207 A 9/1993 Yamamoto
6,595,710 B1 * 7/2003 Hayashi ..... 400/208
6,621,510 B1 9/2003 Hayashi
2002/0024583 A1 2/2002 Hayashi
2002/0186992 A1 12/2002 Hayashi

FOREIGN PATENT DOCUMENTS

EP 1 334 835 A2 8/2003
JP 2001-277627 10/2001

* cited by examiner

*Primary Examiner*—Huan Tran
(74) *Attorney, Agent, or Firm*—Oliff & Berridge, PLC

(57) ABSTRACT

There is provided an ink sheet cartridge, which is provided with a cartridge body, a supply-side core tube, a takeup-side core tube, and spools detachably attached to end portions of the supply-side and takeup-side core tubes, respectively, and at least one intermediate connector that is interposed between at least one of the spools and corresponding one of the end portions of the supply-side and takeup-side core tubes. The corresponding one of the end portions at which the at least one intermediate connector is interposed id formed with a female engagement portion. The ink sheet cartridge further includes a male engagement member that is fitted into the female engagement portion from the outside so that the at least one intermediate connector is engaged with one of the supply-side and takeup-side core tubes having the female engagement portion.

21 Claims, 17 Drawing Sheets

INK SHEET CARTRIDGE AND EXCHANGEABLE INK SHEET SET

BACKGROUND OF THE INVENTION

The present invention relates to an ink sheet cartridge, and to an exchangeable ink sheet set which can be attached to the ink sheet cartridge.

In general, a thermal printer employs an ink ribbon cartridge which eases replacement of an ink ribbon, i.e., handling of the thermal printer. When the thermal printer is configured as a line printer, a wide ink sheet is used.

Japanese Patent Provisional Publication No. 2001-277627 discloses an ink sheet cartridge having the wide ink sheet. The ink sheet cartridge disclosed in this publication includes a supply core tube, a takeup core tube, and a cartridge body. Spools are attached to both ends of the supply core tube and the takeup core tube so that each of the core tubes is rotatably attached via the spools to right and left side walls of the cartridge body.

In the ink sheet cartridge, an intermediate connector is interposed between one of the spools and an end portion of the supply core tube. FIG. 18 schematically shows the intermediate connector 103 and one of the supply core tube 101 as a front view. As shown in FIG. 18, the intermediate connector 103 has a resilient pawl 104 which engages with a mating groove 102 formed at the end portion of the core tube 101. The resilient pawl 104 has an arm portion 104*a* and a pawl portion 104*b*.

The resilient pawl 104 has a form of a letter "L" and extends from a maximum diameter portion 103*a* of the intermediate connector 103 in an axial direction of the core tube 101. When the intermediate connector 103 is inserted into the end portion of the core tube 101, the resilient pawl 104 is also inserted into the mating groove 102. Then, the resilient pawl 104 engages with the mating groove 102.

The above mentioned configuration shown in FIG. 18 requires the intermediate connector 103 to connect the spool (not shown) to the core tube 101. Therefore, the configuration prevents a non-regular ink sheet (e.g., one provided by a non-regular vendor which is different from a regular vendor of the ink sheet cartridge having the configuration shown in FIG. 18) from being erroneously attached to the cartridge body (not shown in FIG. 18).

SUMMARY OF THE INVENTION

In the above mentioned configuration shown in FIG. 18, when the intermediate connector 103 is inserted into the core tube 101, the resilient pawl 104 is inserted into the mating groove 102 by utilizing elastic deformation of the resilient pawl 104 so that the pawl portion 104*b* is hooked to the mating groove 102. For this reason, the width Wb of an axial groove portion 102*a* of the mating groove 102 needs to be larger than the width Wa of the arm portion 104*a* of the resilient pawl 104.

Accordingly, when the resilient pawl 104 is engaged with the mating groove 102 (i.e., the intermediate connector 103 is completely inserted into the core tube 101), clearance is formed between the resilient pawl 104 and inside surfaces of the mating groove 102.

Such a configuration may cause a problem that when force acts on the resilient pawl 104 from an improper direction, for example, during replacement work of the ink sheet, the resilient pawl 104 disengages from the mating groove 102 and thereby the intermediate connector 103 disengages from the core tube 101.

In addition, if a user forces the intermediate connector 103 to push into an improper position of the core tube 101 after the intermediate connector 103 has disengaged from the core tube 101 due to the above mentioned problem, the resilient pawl 104 may be damaged. In this case, the ink sheet set can not be mounted on the ink sheet cartridge.

The present invention is advantageous in that it provides an ink sheet cartridge and an exchangeable ink sheet set, each of which is configured such that an intermediate connector can be firmly engaged with a core tube.

According to an aspect of the invention, there is provided an ink sheet cartridge mountable on an image forming device. The ink sheet cartridge is provided with at least one core tube, and spools detachably attached to end portions of the at least one core tube, respectively, so that the at least one core tube is rotatably supported in the ink sheet cartridge via the spools, and at least one intermediate connector that is interposed between at least one of the spools and corresponding one end portion of the at least one core tube. The corresponding one end portion at which the at least one intermediate connector is interposed is formed with a female engagement portion. The ink sheet cartridge is further provided with a male engagement member that is fitted into the female engagement portion from an outside of the at least one core tube so that the at least one intermediate connector is engaged with the at least one core tube.

With this configuration, since the male engagement member is fitted into the female engagement portion form the outside, it becomes possible to reliably prevent the at least one intermediate connector from being disengaged from the core tube. Consequently, reliability of exchanging work of an ink sheet can be enhanced.

Optionally, the at least one intermediate connector may have a recessed portion. The male engagement member is fixed to the recessed portion of the at least one intermediate connector by press fitting.

With this structure, firm engagement between the male engagement member and the at least one intermediate connector can be secured.

Still optionally, one of the male engagement member and the recessed portion of the at least one intermediate connector may have a pin, and the other of the male engagement member and the recessed portion of the at least one intermediate connector may have a insertion hole. In this case, the male engagement member is fixed to the recessed portion of the at least one intermediate connector by pressing the pin into the insertion hole.

In a particular case, the at least one intermediate connector may have a recessed portion, and the male engagement member may be fixed to the recessed portion of the at least one intermediate connector by adhesive bonding.

With this structure, firm engagement between the male engagement member and the at least one intermediate connector can be secured.

Optionally, the at least one intermediate connector may have a cylindrical form. In this case, the male engagement member includes a base that is fixed to the at least one intermediate connector, an arm portion extending from the base, and an engagement pawl formed at an end of the arm portion opposite to the base, the engagement pawl extending to cross a longitudinal direction of the arm portion. The female engagement portion includes an opening extending in an axial direction of the at least one core tube, and a catching portion extending in a circumferential direction of the at least one core tube. The arm portion and the engagement pawl of the male engagement member are fitted into the opening and the catching portion of the female engagement portion, respectively.

With this structure, since the engagement pawl can be hooked to the catching portion, locking engagement between the at least one intermediate connector and the core tube in the axial direction can be secured.

Still optionally, the arm portion of the male engagement member and the opening of the female engagement portion may have sizes substantially equal to each other in the circumferential direction. In this case, movement of the male engagement member is restricted to a radial direction of the at least one core tube in a situation where the male engagement member has been fitted into the female engagement portion.

Still optionally, the arm portion and the engagement pawl of the male engagement member may be formed in a shape of a letter L, and the opening and the catching portion of the female engagement portion may be formed in a shape of a letter L.

Alternatively, the arm portion and the engagement pawl of the male engagement member may be formed in a shape a letter T, and the opening and the catching portion of the female engagement portion may be formed in a shape of a letter T.

Optionally, the at least one intermediate connector may have: a maximum diameter portion having a maximum diameter of the at least one intermediate connector, a diameter of the maximum diameter portion being equal to an outer peripheral surface of the at least one core tube; and a recessed portion formed at the maximum diameter portion. The base of the male engagement member is fitted into the recessed portion of the at least one intermediate connector.

Still optionally, the male engagement member may have an outer peripheral surface whose cross section is configured to be a part of a circular arc having a radius of curvature equal to that of the outer peripheral surface of the at least one core tube.

In a particular case, the one of the end portions at which the at least one intermediate connector is interposed may be formed with a cutout groove extending from the one of the end portions at which the at least one intermediate connector is interposed, in an axial direction of the at least one core tube. In this case, the at least one intermediate connector has a protruding segment portion protruding outwardly in a radial direction of the at least one intermediate connector, the protruding segment portion of the at least one intermediate connector being fitted into the cutout groove of the at least one core tube. Further, a size of the protruding segment portion in a circumferential direction of the at least one intermediate connector is larger than a width of the opening of the female engagement portion.

Optionally, an ink sheet may be wound on the at least one core tube such that the ink sheet covers at least a portion of the male engagement member.

In a particular case, the at least one intermediate connector may have a cylindrical form and may be made of flexible material. In this case, the male engagement member is integrally formed with the at least one intermediate connector. The male engagement member resiliently deforms in a radial direction of the at least one intermediate connector so as to engage with and to disengage from the female engagement portion. The male engagement member is fitted into the female engagement portion by restoring force thereof acting inwardly in the radial direction.

With this configuration, since the male engagement member is fitted into the female engagement portion form the outside, it becomes possible to reliably prevent the at least one intermediate connector from being disengaged from the core tube. Consequently, reliability of exchanging work of an ink sheet can be enhanced. Further, since the male engagement member is integrally formed with the intermediate connector, attachment work of the intermediate connector to the core tube can be facilitated.

Optionally, the at least one intermediate connector may have a maximum diameter portion having a maximum diameter of the at least one intermediate connector. In this case, the male engagement member of the at least one intermediate connector includes an arm portion extending from the maximum diameter portion of the at least one intermediate connector, and an engagement pawl formed at an end of the arm portion, the engagement pawl extending to cross a longitudinal direction of the arm portion. The arm portion is formed to be a thin plate so as to have flexibility in the radial direction.

Wit this structure, the male engagement member can be bent outwardly relatively easily, attachment work of the intermediate connector to the core tube can be facilitated.

Still optionally, the at least one intermediate connector may have a maximum diameter portion having a maximum diameter of the at least one intermediate connector. The male engagement member of the at least one intermediate connector includes an arm portion extending from the maximum diameter portion of the at least one intermediate connector, and an engagement pawl formed at an end of the arm portion, the engagement pawl extending to cross a longitudinal direction of the arm portion. Slits are formed on the maximum diameter portion of the at least one intermediate connector at both sides of the arm portion of the male engagement member.

Wit this structure, the male engagement member can be bent outwardly relatively easily, attachment work of the intermediate connector to the core tube can be facilitated.

Still optionally, the female engagement portion may include an opening extending in an axial direction of the at least one core tube, and a catching portion extending in a circumferential direction of the at least one core tube. The arm portion and the engagement pawl of the male engagement member are fitted into the opening and the catching portion of the female engagement portion, respectively.

Still optionally, a diameter of the maximum diameter portion may be equal to an outer peripheral surface of the at least one core tube.

In a particular case, the one of the end portions at which the at least one intermediate connector is interposed may be formed with a cutout groove extending from the one of the end portions at which the at least one intermediate connector is interposed, in an axial direction of the at least one core tube. The at least one intermediate connector has a protruding segment portion protruding outwardly in a radial direction of the at least one intermediate connector, the protruding segment portion of the at least one intermediate connector being fitted into the cutout groove of the at least one core tube. A size of the protruding segment portion in a circumferential direction of the at least one intermediate connector is larger than a width of the opening of the female engagement portion.

In a particular case, the at least one intermediate connector may be made of a synthetic resin.

According to another aspect of the invention, there is provided an exchangeable ink sheet set used with at least one intermediate connector, a male engagement member and spools in an ink sheet cartridge. The ink sheet set is provided with an ink sheet having a predetermined width, and a plurality of core tubes including a supply-side core tube mountable on the ink sheet cartridge at a supply side and a takeup-side core tube mountable on the ink sheet cartridge at a takeup side.

In this structure, the spools are detachably attached to end portions of the plurality of core tubes, respectively, so that the plurality of core tubes are rotatably mounted on the ink sheet cartridge via the spools. The at least one intermediate connector is interposed between at least one of the spools and corresponding one of the end portions of at least one core tube of the plurality of core tubes. The corresponding one of the end portions at which the at least one intermediate connector is interposed is formed with a female engagement portion. The male engagement member being fitted into the female engagement portion from an outside of the at least one core tube so that the at least one intermediate connector is engaged with the at least one core tube.

With this configuration, since the male engagement member is fitted into the female engagement portion form the outside, it becomes possible to reliably prevent the at least one intermediate connector from being disengaged from the core tube. Consequently, reliability of exchanging work of the ink sheet can be enhanced.

Optionally, the at least one intermediate connector may have a cylindrical form and may be made of flexible material. In this case, the male engagement member is integrally formed with the at least one intermediate connector. The male engagement member resiliently deforms in a radial direction of the at least one intermediate connector so as to engage with and to disengage from the female engagement portion. The male engagement member is fitted into the female engagement portion by restoring force thereof acting inwardly in the radial direction.

With this configuration, since the male engagement member is integrally formed with the intermediate connector, attachment work of the intermediate connector to the core tube can be facilitated.

BRIEF DESCRIPTION OF THE ACCOMPANYING DRAWINGS

DETAILED DESCRIPTION OF THE EMBODIMENTS

Hereafter, embodiments according to the present invention will be described with reference to the accompanying drawings.

First, a configuration of a facsimile machine 1 in which an ink sheet cartridge and an exchangeable ink sheet set according to a first embodiment (and second and third embodiments) of the invention can be mounted will be described with reference to FIGS. 1 and 2.

Figure 1:
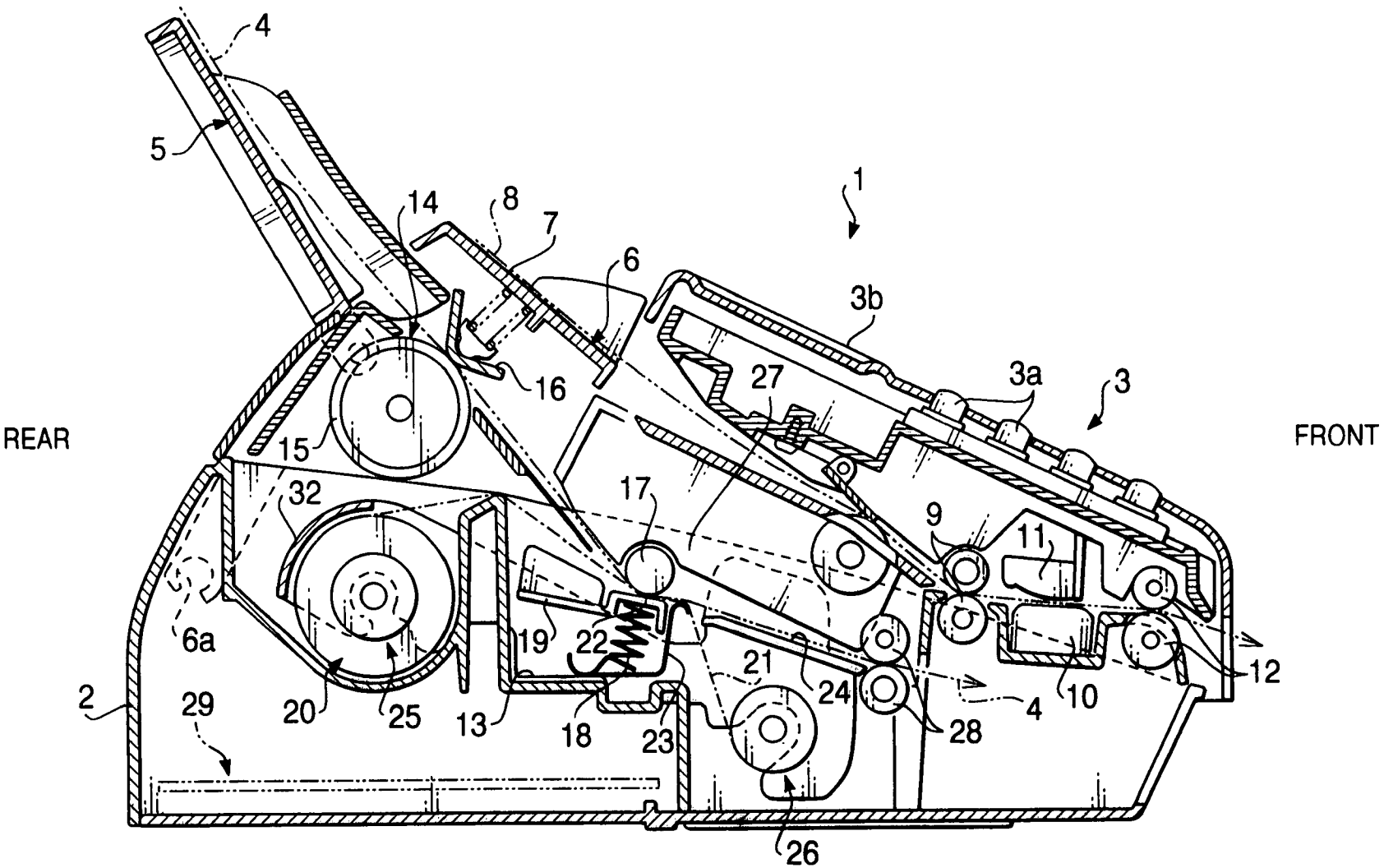
FIG. 1 is a cross-sectional side view showing a facsimile device in which an ink sheet cartridge according to the present invention is used.

FIG. 1 is a side cross-sectional view illustrating the entire configuration of the facsimile machine 1. FIG. 2 is an enlarged view of a printing portion of the facsimile machine 1 shown in FIG. 1. In FIG. 2 a sheet carrying path of a recording sheet 4 is indicated by an arrow.

The facsimile machine 1 is configured to function as a facsimile machine and a printer. That is, the facsimile machine 1 reads an original 8 to obtain image data, and transmits the image data to another facsimile machine through communication lines (e.g., phone lines). Also, the facsimile machine 1 receives image data from another facsimile machine through the communication lines and forms an image of the received image data on the recording sheet 4.

The facsimile machine 1 receives printing data from external devices, such as a personal computer and a word processor, by wire communication (which uses, for example, a printer cable) or wireless communication (which uses, for example, an infrared rays), and forms an image of the received printing data on the recording sheet 4.

As shown in FIG. 1, the facsimile machine 1 has a body case 2, an upper cover 6, an operation panel 3, a sheet feed stand 5, and an original stand 7. On one side of the body case 2, a handset (not shown) is provided. The body case 2 has an upper opening. The upper cover 6 is positioned to cover the upper opening of the body case 2. The upper cover 6 is attached to the body case 2 to be pivotally movable in a vertical direction about a pivot point 6*a*.

The operation panel 3 is positioned on the front upper side of the upper cover 6. The operation panel 3 has key switches 3*a* and LCD (liquid crystal display) 3*b*. The operation panel 3 is also pivotally movable about its rear end portion such that its front end moves upwardly in order to remove originals 8 jammed inside of the facsimile machine 1.

The sheet feed stand 5 is positioned on the upper rear side of the body case 2 such that it is pivotally movable about an rear end portion of the body case 2. The sheet feed stand 5 holds a stack of recording sheets 4 in a slanted direction such that leading ends of the recording sheets 4 are lower than the trailing ends of the recording sheets 4.

In the body case 2, a pair of feed rollers 9, a contact type image scanner portion (CIS) 10, an original holder 11, a pair of discharge rollers 12 are provided below the operation panel 3. The feed rollers 9 transfer the original 8 toward the CIS 10. The original holder 11 is positioned above the CIS 10 to press the original 8.

In the body case 2, a sheet feeding portion 14 is provided below the sheet feed stand 5. The sheet feeding portion 14 includes a sheet supply roller 15 for feeding the recording sheets 4 one by one from the sheet feed stand 5 into an inside of the facsimile machine 1. The sheet feeding portion 14 further includes a separation pad 16. The separation pad 16 is pressed against an upper peripheral surface of the sheet supply roller 15 by a spring.

Below the sheet feeding portion 14, a roller shaped platen 17, a spring 18, a print stand 19, a thermal head 22, and an accommodating portion 13 are provided. The thermal head 22 is located on the print stand 19 and is pressed against a lower peripheral surface of the platen 17. The accommodation portion 13 accommodates therein an ink sheet cartridge 20 in such a manner that the ink sheet cartridge 20 extends from a front side of the print stand 19 to a rear side of the print stand 19.

In the accommodation portion 13, the ink sheet cartridge 20 is provided such that a supply sheet spool 25 is positioned at the rear side of the body case 2 and a takeup sheet spool 26 is positioned at the front side of the body case 2. Further, a position of the takeup sheet spool 26 is lower than that of the supply sheet spool 25. That is, the ink sheet cartridge 20 is positioned in the accommodating position 13, in a front low and rear high orientation (hip-up orientation).

With the hip-up orientation of the ink sheet cartridge 20, a relatively large space is formed, in the body case 2, below the rear side portion of the ink sheet cartridge 20. In this relatively large space of the body case 2, a control board 29, which controls operation of the facsimile machine 1, is arranged below the rear side portion of the ink sheet cartridge 20.

When an ink sheet 21 is fed from the supply sheet spool 25 to the takeup sheet spool 26, the ink sheet 21 passes the thermal head 22 and a top 23*a* of a tension member 23, and then reaches a lower peripheral surface of the takeup sheet spool 26 while an ink surface of the ink sheet 21 facing upward.

The recording sheet 4 fed from the sheet feed stand 5 overlaps with the upper surface (ink surface) of the ink sheet 21 between the thermal head 22 and the platen 17, so that an image is formed on the recording sheet 4. Then, the recording sheet 4 passes an upper side of a partitioning plate 24 which is formed above the takeup spool 26 in the ink sheet cartridge 20. Next, the recording sheet 4 is discharged by discharge rollers 28 on the front side of the facsimile machine 1.

On a bottom surface of the upper cover 6, a plurality of rib like chutes 27 extending downward are formed. Each chute 27 extends from an upstream side of the platen 17 and a downstream side of the platen 17. The recording sheet 4 is carried between the chutes 27 and the partitioning plate 24 of the ink sheet cartridge 20. With this structure, the chutes 27 and the partitioning plate 24 function as a carrying chute.

The ink sheet 21 is bent downward at the top 23*a* of the tension member 23, and passes below the partitioning plate 24 to be wound, by the takeup sheet spool 26, on the lower surface side of the takeup spool 26.

Figure 8:
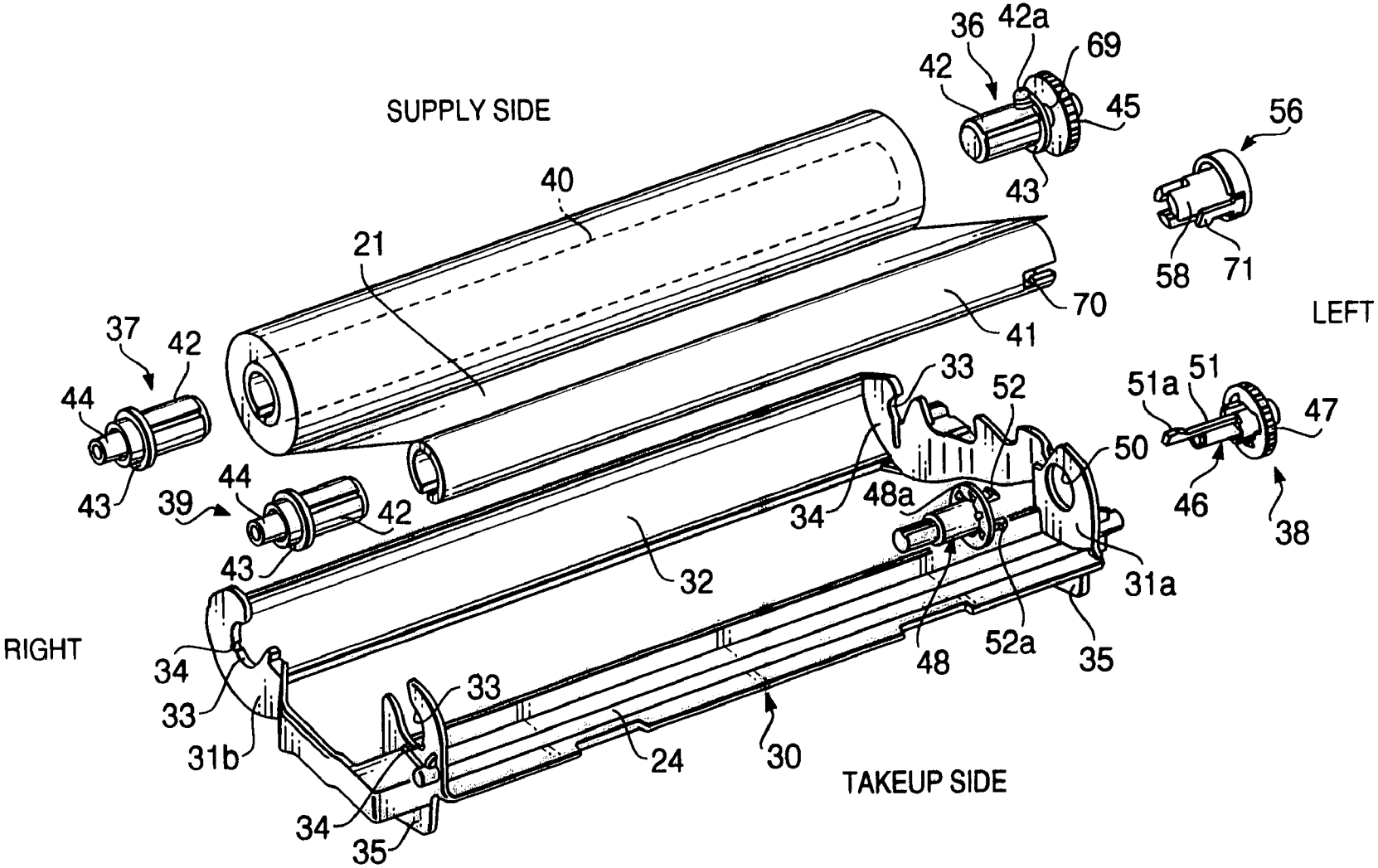
FIG. 8 is an exploded perspective view showing components of the ink sheet cartridge where the ink sheet cartridge is turned upside down.

Next, the configuration of the ink sheet cartridge 20 according to the first embodiment will be described in detail with reference to FIGS. 3 through 11. As shown in FIGS. 5 and 8, the supply sheet spool 25 includes a left spool 36, a right spool 37, and a cylindrical core tube 40. Also, the takeup sheet spool 26 includes a left spool 38, an intermediate connector 56 having a cylindrical shape, a right spool 39, and a cylindrical core tube 41. The ink sheet 21 includes a wide resin film having the ink surface, and is wound around the core tubes 41 and 42.

The core tubes 40 and 41 are formed of, for example, a rigid paper. The spools 36 and 37 are detachably insertable into left and right ends of the core tube 40. The spool 39 is detachably insertable into the right end of the core tube 41. Each of the spools 36, 37 and 39 is formed of a synthetic resin by injection molding technique. As shown in FIG. 8, each of the spools 37 and 39 has a shaft 44 integrally formed with a flange 43. The remaining spool 38 is a composite member including a plurality of components.

Figure 3:
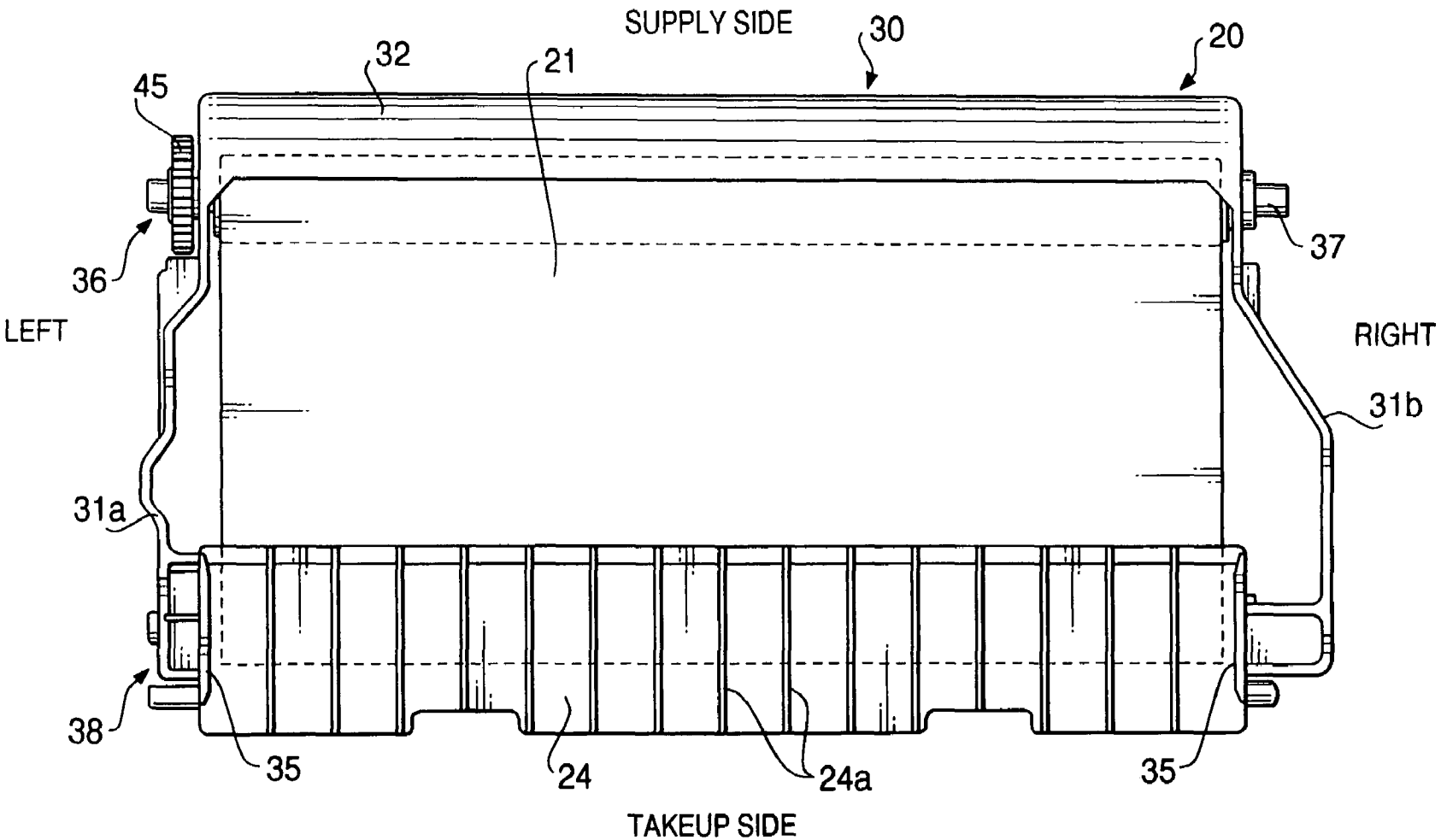
FIG. 3 is a plan view showing an ink sheet cartridge according to a first embodiment of the present invention.
Figure 4:
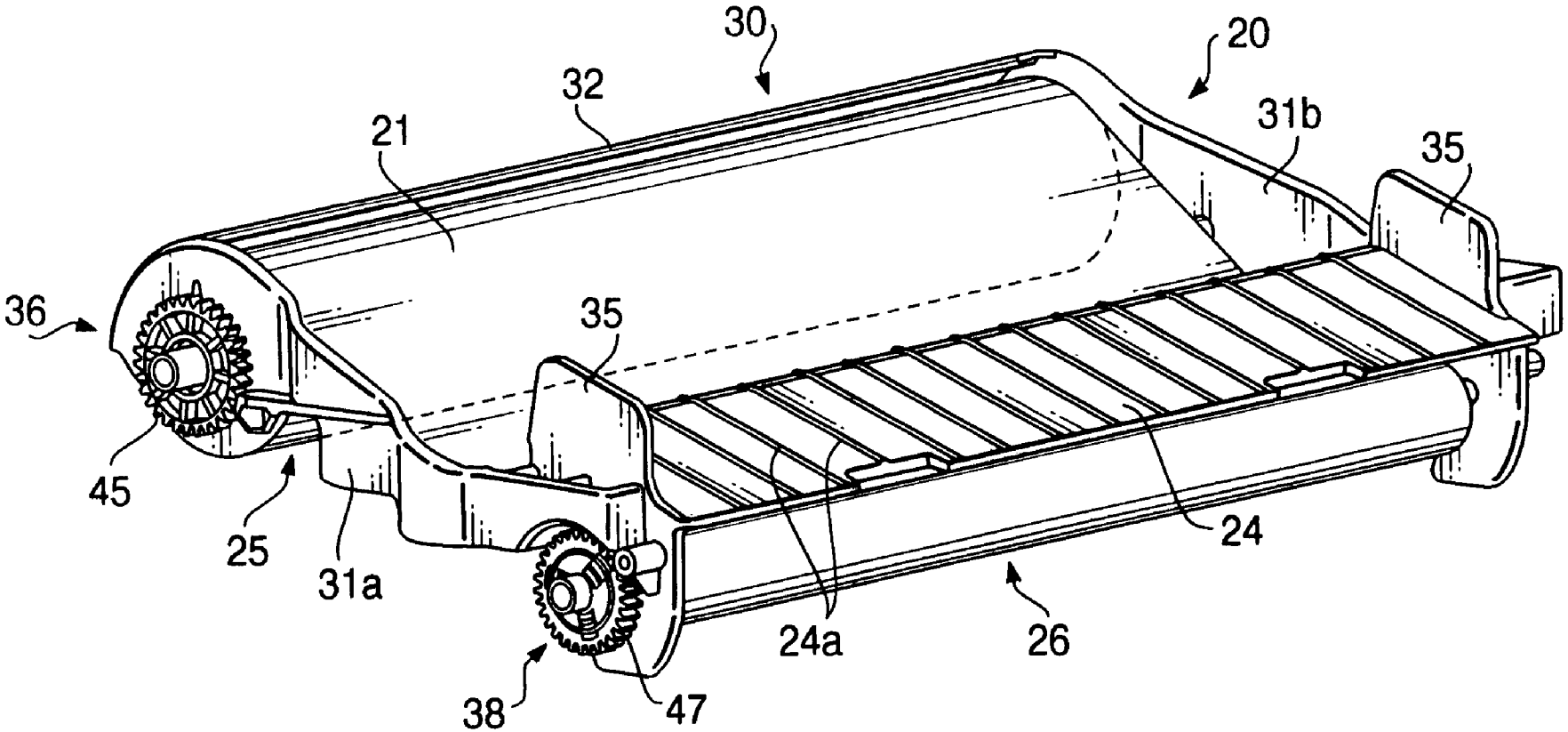
FIG. 4 is a perspective view showing the ink sheet cartridge of FIG. 3 as viewed from a front left side thereof.
Figure 5:
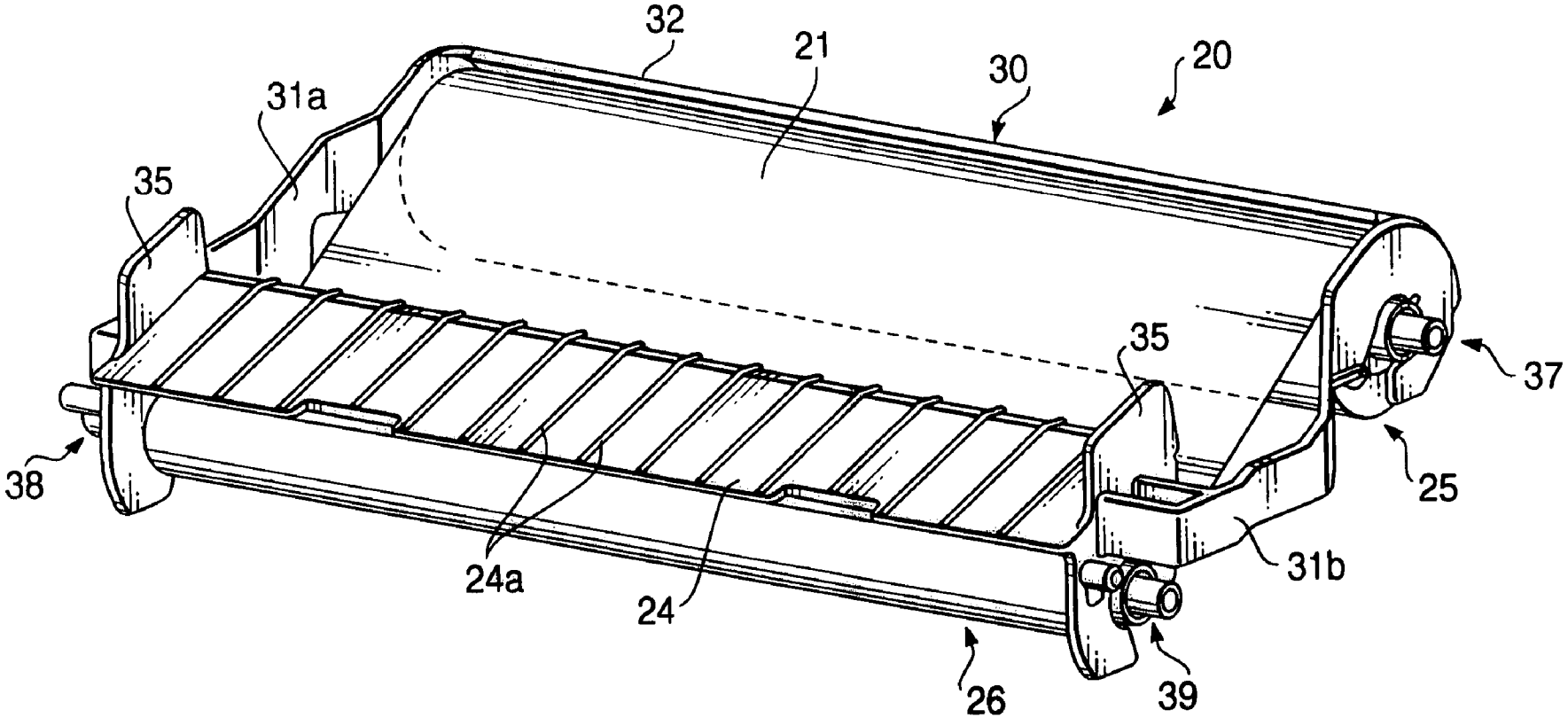
FIG. 5 is a perspective view showing the ink sheet cartridge as viewed from a front right side thereof.
Figure 6:
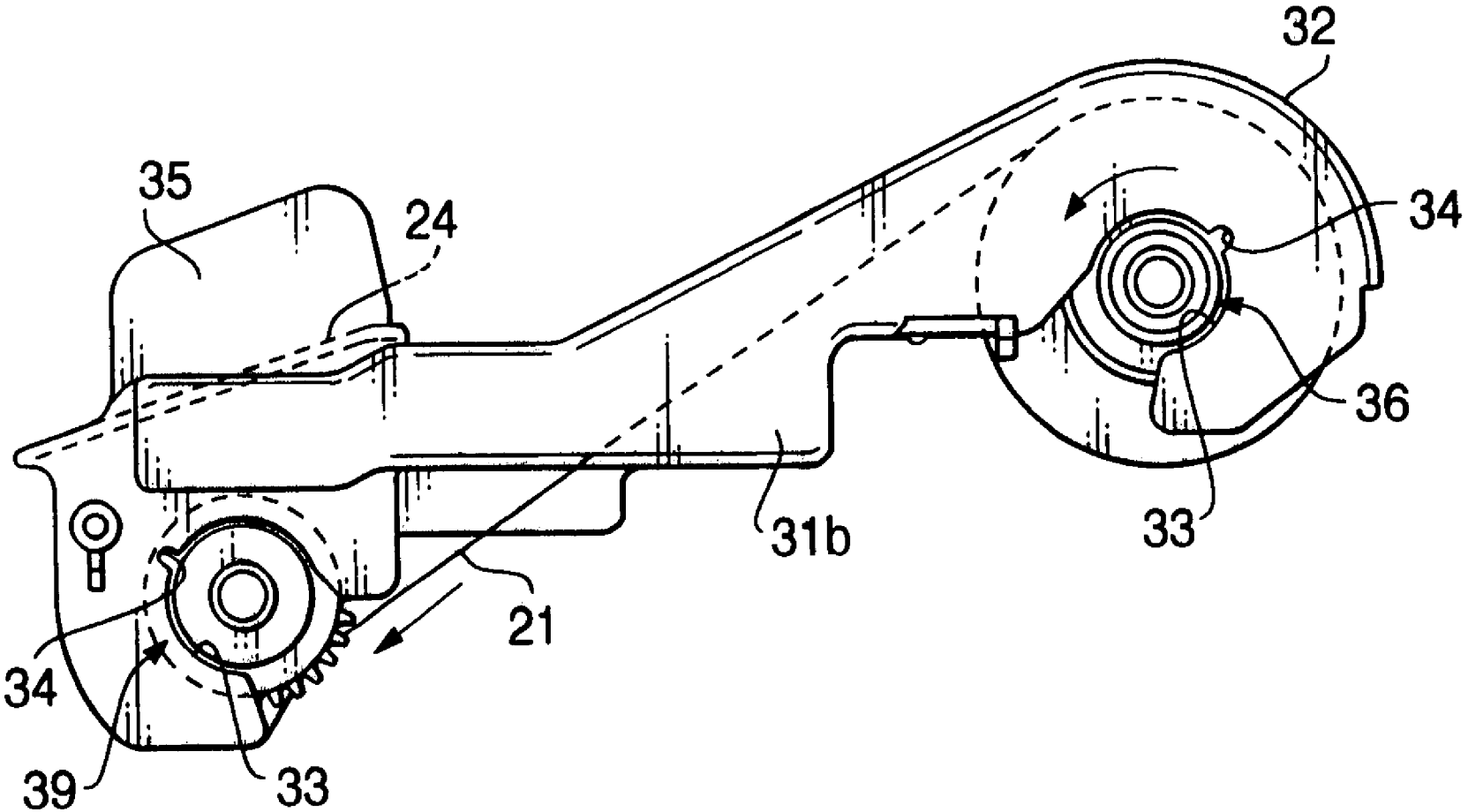
FIG. 6 is a right side view showing the ink sheet cartridge.
Figure 7:
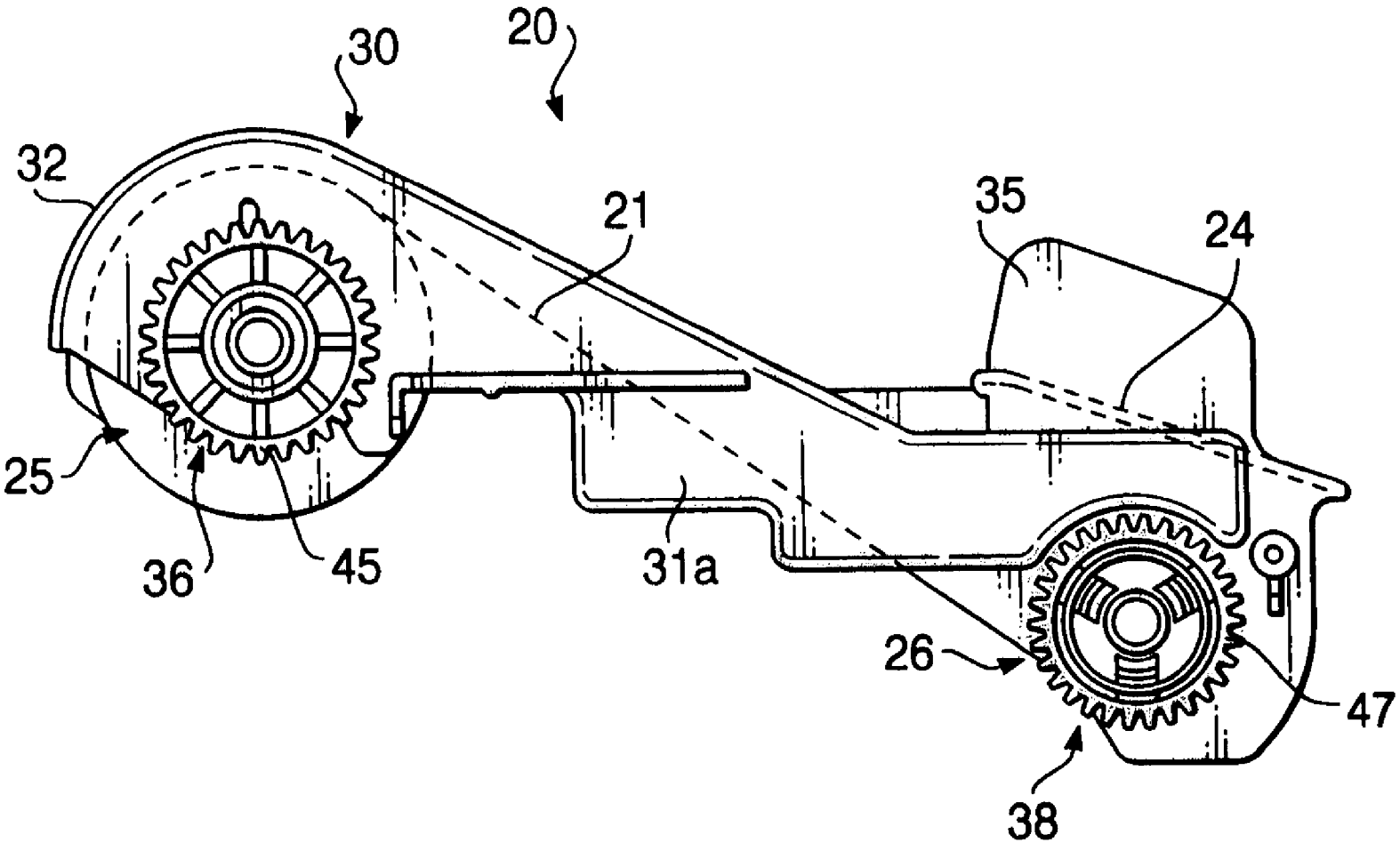
FIG. 7 is a left side view showing the ink sheet cartridge.

As shown in FIGS. 3 to 5, the ink sheet cartridge 20 has a cartridge body 30. The cartridge body 30 includes a pair of left and right side plates 31*a* and 31*b*, an upper cover segment 32, and the partitioning plate 24, all integrally formed from a synthetic resin by injection molding. The left and right side plates 31*a* and 31*b* extend from the supply side to the takeup side, and are positioned beside the left and right edges of the ink sheet 21.

The upper cover segment 32 is bridged between the left and right side plates 31*a* and 31*b*, and covers an upper area of a supply side sheet roll. The partitioning late 24 is bridged between the left and right side plates 31*a* and 31*b*, and covers an upper area of a takeup-side sheet roll. The upper surface of the partitioning plate 24 is formed with a plurality of rib-like projections 24*a* protruding upwardly.

With this configuration, the upper cover segment 32, the partitioning plate 24, and the left and right side plates 31*a* and 31*b* define an open area among them where the ink sheet 21 is exposed.

Figure 2:
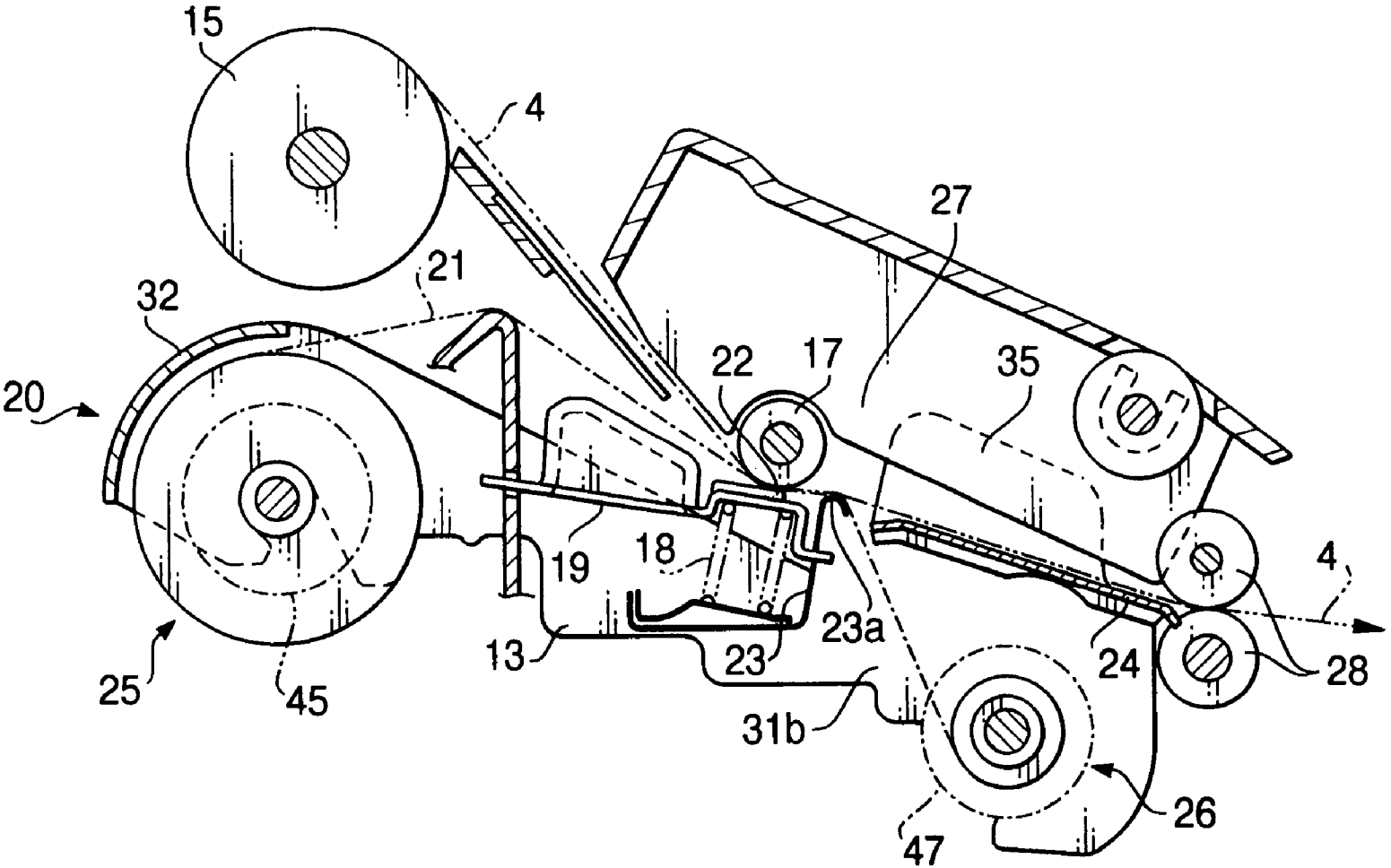
FIG. 2 is a cross-sectional partial side showing an ink sheet passage and a recording sheet passage near a printing portion of the facsimile device of FIG. 1.

As shown in FIGS. 1 and 2, when the ink sheet cartridge 20 is accommodated in the accommodating portion 13 of the body case 2, the platen 17 is positioned above the open area, and the print stand 19, the thermal head 22, and the tension member 23 are positioned below the open area.

As shown in FIGS. 3 to 5, fin like knob portions 35 and 35 protrude upwardly from left and right sides of the partitioning plate 24 so that a user can holds the ink sheet cartridge 24 by the knob protrusions 35 and 35.

As shown in FIG. 8, the right side plate 31*b* is formed with a pair of shaft support grooves 33 at its supply side and takeup side for rotatably supporting the shafts 44 of corresponding ones of the right spool 37 and the right spool 39. The left side plate 31*a* is formed with a shaft support groove 33 at its supply side for rotatably supporting a shaft 69 of the left spool 36, and a shaft hole 50 at its takeup side for rotatably supporting the left spool 38. Each shaft support groove 33 is formed with an open portion at its lower portion, through which the shaft 44,69 of the corresponding spool 36,37,39 can be forcibly pushed into the shaft support groove 33.

Also, each shaft support groove 33 is in communication with a slit like relief groove 34 extending radially outwardly from each shaft support groove 33. When the shafts 44, 69 are pushed into the respective shaft support grooves 33, the open portions of the shaft support grooves 33 resiliently expand because of the relief grooves 34. Upon complete insertion of the shafts 44,69 into the respective shaft support grooves 33, the open portions restore their original shapes to prevent the shafts 44,69 from being disengaged from the shaft support grooves 33.

Figure 12A:
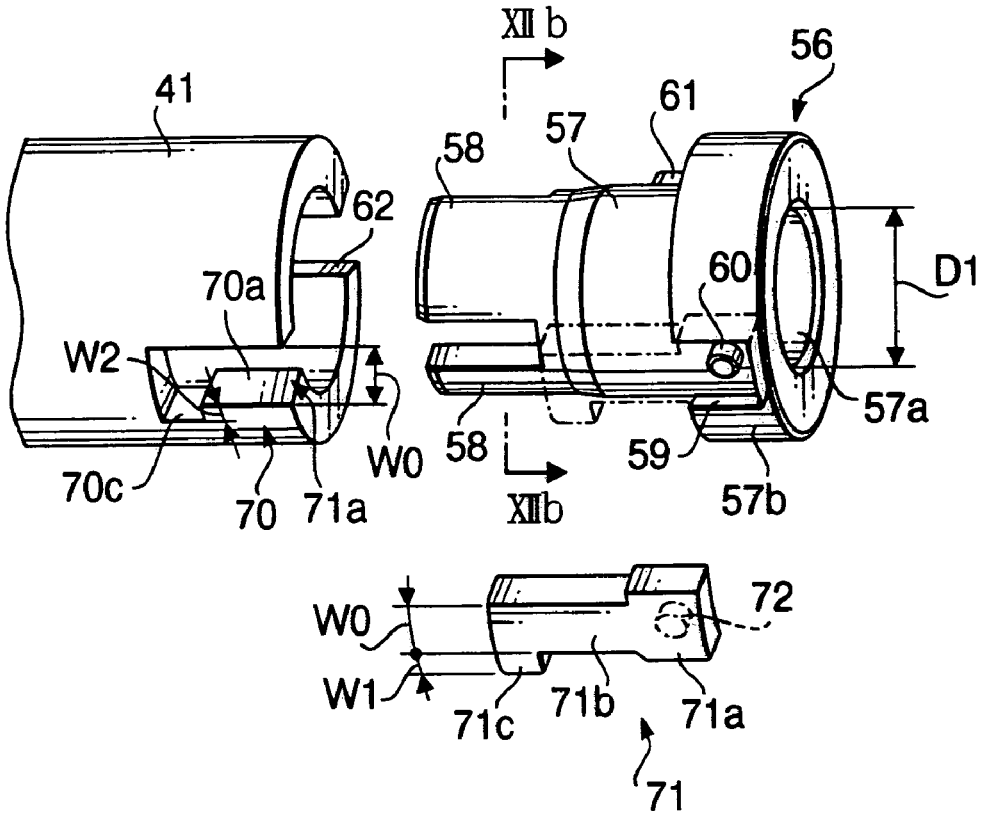
FIG. 12A is a perspective view showing an intermediate connector a male engagement member and the core tube.

At the left end portion of the core tube 41 (the left side when the facsimile machine 1 is viewed form the sheet ejecting side thereof), a female engagement portion 70 and a cutout groove 62 are formed at positions opposite to each other with respect to an axial line of the core tube 41 (see FIGS. 8 and 12A). As described in detail later, to the female engagement portion 70, a male engagement member 71 is inserted. To the cutout groove 62, protruding segments 61 of the intermediate connector 56 are inserted.

Each of the female engagement portion 70 and the cutout groove 62 is opened toward the left end of the core tube 41. The female engagement portion 70 has an opening 70*a* having a width of W0 and extending along the axial direction of the core tube 41. The female engagement portion 70 further has a catching notch 70*c* formed at one end of the opening 70*c* opposite to the left end of the core tube 41. The catching notch 70*c* extends in a circumferential direction of the core tube 41 with respect to the opening 70*a* so that an additional size of W2 is further opened in the circumference direction.

As shown in FIG. 8, the spools 37, 39 have configurations identical with each other. Each of the spools 37, 39 includes an inner sleeve 42, the flange 43, and the cylindrical shaft 44. The inner sleeve 42 is engageable with a right end inner peripheral surface of corresponding one of the supply side core tube 40 and the takeup-side core tube 41. The flange 43 has a diameter larger than that of the inner sleeve 42, and the shaft 44 has a diameter smaller than that of the inner sleeve 42.

The supply-side left spool 36 includes an inner sleeve 42, the shaft 69, a large diameter flange 43, and a gear wheel 45. The inner sleeve 42 is engageable with a left-side inner-peripheral surface of the supply-side core tube 40. The inner sleeve 42 is integrally formed with an engaging pawl 42*a* for engaging with a notched groove (not shown) formed on the core tube 40. The shaft 69 is positioned outwardly of the flange 43, and the gear wheel 45 is positioned outwardly of the shaft 69. The shaft 69 is positioned between the flange 43 and the gear wheel 45. With this structure, torque is securely transmitted from the inside of the facsimile machine 1 to the supply sheet spool 25.

Figure 9:
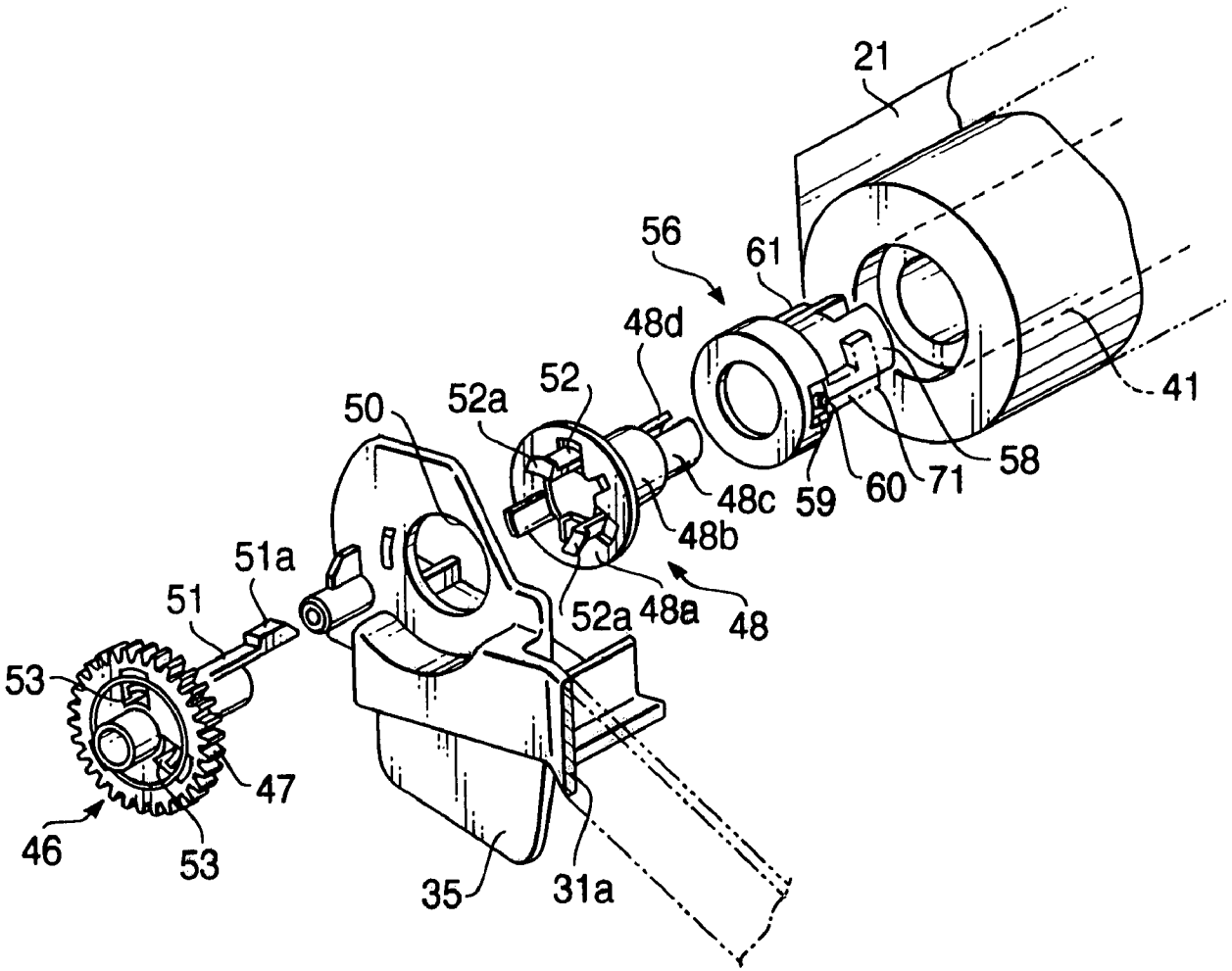
FIG. 9 is an exploded perspective view of a takeup-side left spool.

As shown in FIGS. 8 and 9, the takeup-side spool 38 includes a first rotation member 46 and a shaft member 48, each formed from synthetic resin, such as nylon resin, and produced by injection molding. The first rotation member 46 is formed with a transmission gear 47. Once the first rotating member 46 and the shaft member 48 are fitted with each other in the shaft whole 50 while the side plate 31*a* interposed therebetween, the first rotating member 46 and the shaft member 48 are unreleasable from each other.

Figure 10A:
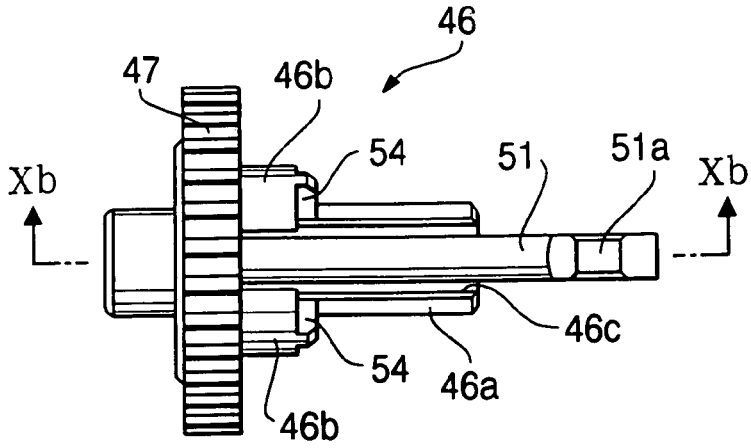
FIG. 10A is a front view showing a first rotation member of the takeup-side left spool of FIG. 9.
Figure 10B:
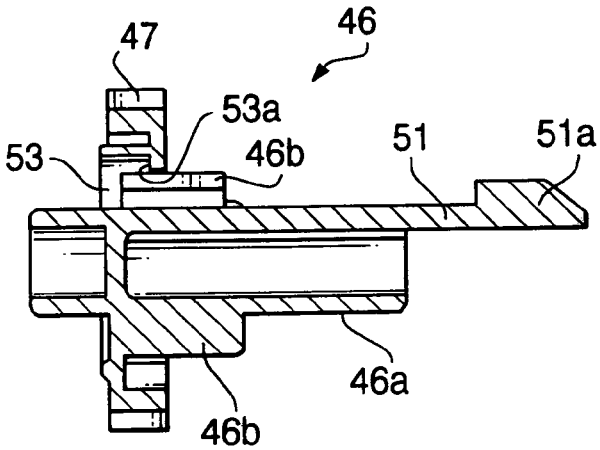
FIG. 10B is a cross-sectional view of the first rotation member taken along the line Xb—Xb in FIG. 10A.
Figure 10D:
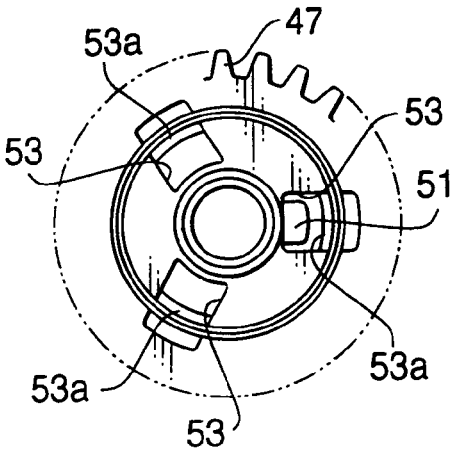
FIG. 10D is a left side view of the first rotation member.
Figure 10C:
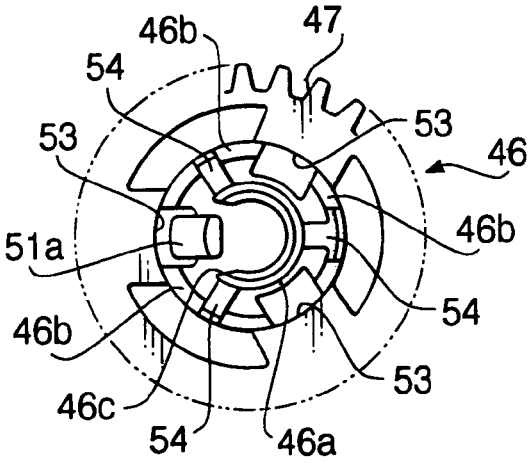
FIG. 10C is a right side view of the first rotation member.

As shown in FIGS. 10A through 10C, the transmission gear 47 has an inner peripheral surface formed with an inner sleeve 46*a* having a cylindrical form and extending from the inner peripheral surface in an axial direction of the transmission gear 47. The inner sleeve 46*a* is formed with a slot 46*c*.

On the inner peripheral surface of the transmission gear 47, a rod-like resilient member 51 is integrally formed. The resilient member 51 extends through the slot 46*c* of the inner sleeve 46*a*. Both the slot 46*c* and the resilient member 51 extend in the axial direction. The resilient member 51 has a free end integrally provided with an engagement pawl 51*a*, which projects radially outwardly.

On the radially outer side of the inner sleeve 46*a*, three fan-shaped portions 46*b* are formed. As shown in FIGS. 10B to 10D, three fitting holes 53 are formed between neighboring fan-shaped portions 46*b*. The three holes 53 engage with engaging members 52 formed on a flange 48*a* of the shaft member 48.

Stepped portions 53*a* are provided at radially outer side of the fitting holes 53. As shown in FIG. 10C, the fan-shape portions 46*b* are integrally provided with positioning projections 54. Each positioning projection 54 is provided at a position facing the shaft member 48. Each positioning projection 54 protrudes in the axial direction and also extends in a radial direction of the circular transmission gear 47.

Next, a detailed configuration of the shaft member 48 will be described with reference to FIGS. 11A to 1C. The shaft member 48 has the flange 48*a* which is provided with a sleeve base 48*b*, on an inner peripheral surface thereof, extending in the axial direction. At a tip portion of the sleeve base 48*b*, a guide portion 48*c* extending in the axial direction and having a diameter smaller than that of the sleeve base 48*b* is formed. The guide portion 48*c* is formed with a cutout guide groove 48*d*.

When the first rotation member 46 and the shaft member 48 are engaged with each other, the resilient member 51 and the engagement pawl 51*a* of the first rotation member 46 penetrate through the inner space of the sleeve base 48*b* and the guide portion 48*c*. Three engaging members 52 extend from a radially intermediate portion of the flange 48*a* in a direction opposite to the sleeve base 48*b*.

Engagement pawls 52*a* are respectively formed at end portions of the engaging members 52 for locking engagement with the stepped portions 53*a* of the first rotation member 46. Positioning holes 55 are formed on the flange 48*a* for engagement with the positioning projections 54 of the first rotation member 46 (see FIGS. 11B and 11C).

With this arrangement, the first rotation member 46 and the shaft member 46 are fitted to the shaft hole 50 of the cartridge body 30 in the following manner. First, as shown in FIG. 9, the resilient member 51 of the first rotation member 46 is inserted into the shaft hole 50 from the outside of the left side plate 31*a*. Next, the three engaging member 52 of the shaft member 48 are inserted into the engagement holes 53 of the first rotation member 46 from the inner side of the left side plate 53*a* while sandwiching the left side plate 31*a* between the first rotation member 46 and the shaft member 48. Consequently, the engagement pawl 52*a* of each engagement member 52 is brought into licking engagement with each stepped portion 53*a*. The first rotation member 46 and the shaft member 48 are thus connected together and held at the shaft hole 50 unreleasable from the cartridge body 30.

At this time, the positioning projections 54 of the first rotation member 46 also engage with respective positioning holes 55 of the shaft member 48. Also, the resilient member 51 engages with the cutout guide groove 48*d* of the guide portion 48*c*. As shown in FIG. 11C, positioning holes 55 have shapes different at every angular position. Also, the shapes of the positioning projections 54 respectively located at different angular positions are different one another. With this configuration, the first rotation member 46 and the shaft member 48 are attached to each other only in a predetermined positional relationship that the resilient member 51 can be inserted into the cutout guide groove 48*d*.

Figure 14A:
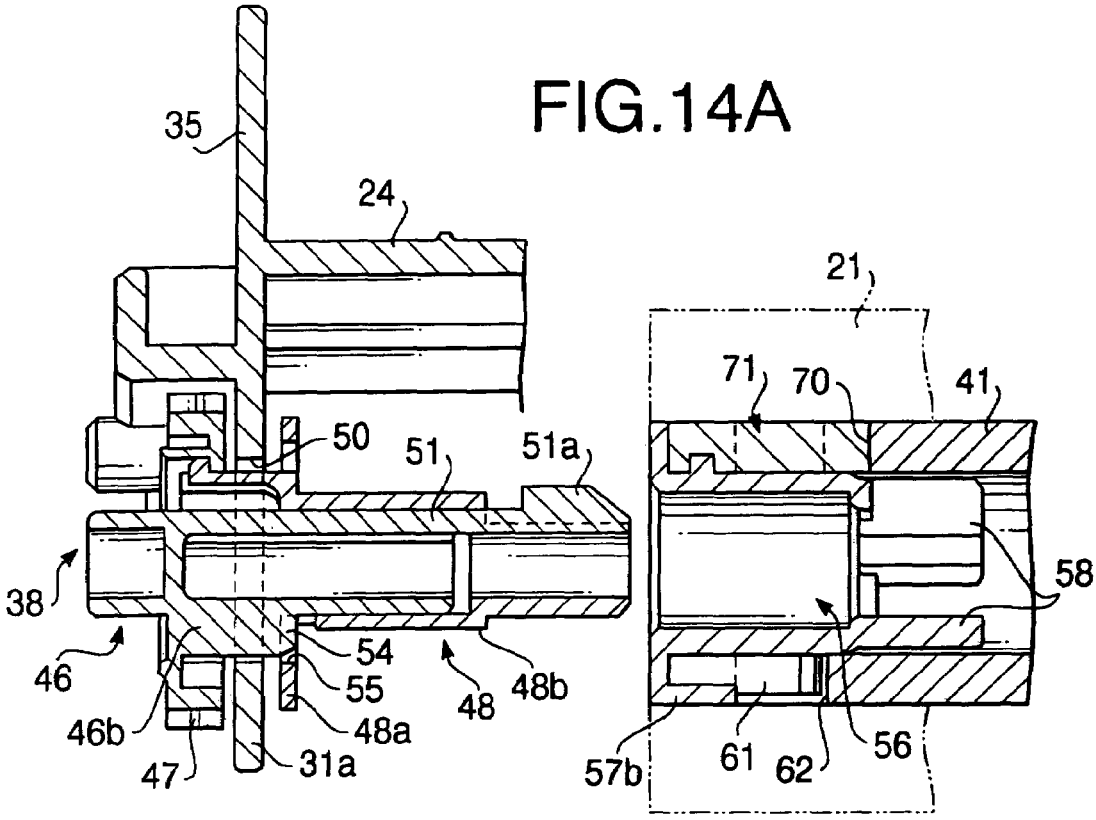
FIG. 14A is an enlarged cross-sectional view showing the first rotation member and the shaft member engaged with each other and the intermediate connector engaged with the core tube.
Figure 14B:
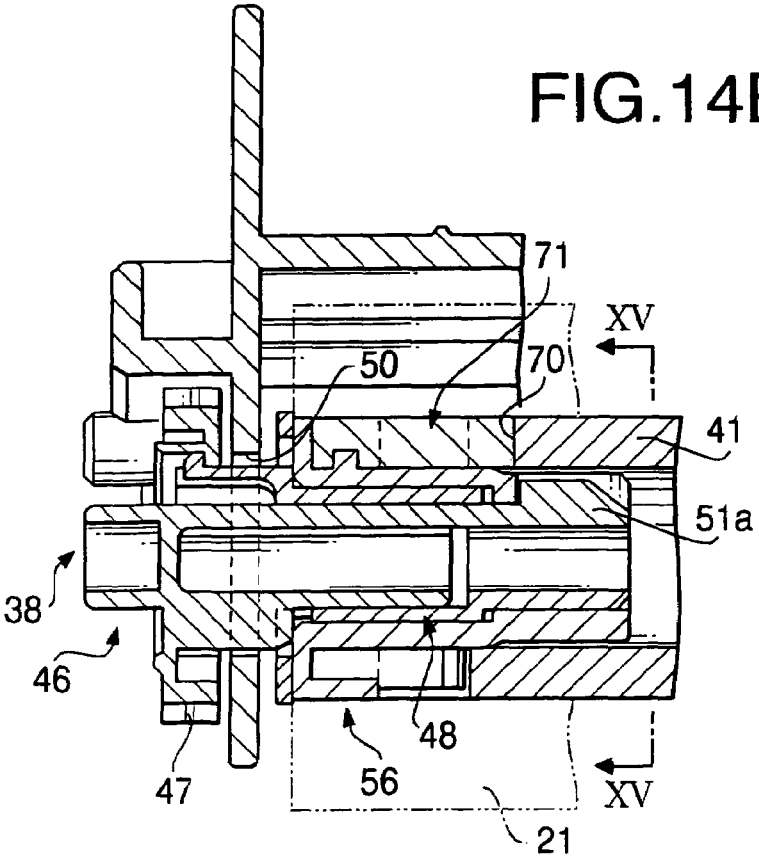
FIG. 14B is an enlarged cross-sectional view showing a complete assemble of the first rotation member, the shaft member, the intermediate connector, and the core tube.

When the first rotation member 46 and the shaft member 48 are in engagement with each other, the engaging member 52 of the shaft member 48 and the fan-shaped portion 46*b* of the first rotation member 46 define a cylindrical member. The cylindrical member is fitted into the shaft hole 50. The cylindrical member defines an axial position of the transmission gear 47 and the left spool 38 along the axial direction (see FIGS. 14A and 14B).

Next, the intermediate connector 56 and the male engagement member 71 according to the first embodiment will be described in detail with reference to FIGS. 12A through 15. The intermediate connector 56 has a cylindrical base 57. The cylindrical base 57 is integrally formed with three cam segments 58 at its tip portion. The three cam segments 58 are arranged in a circumferential direction of the cylindrical base 57.

Figure 11A:
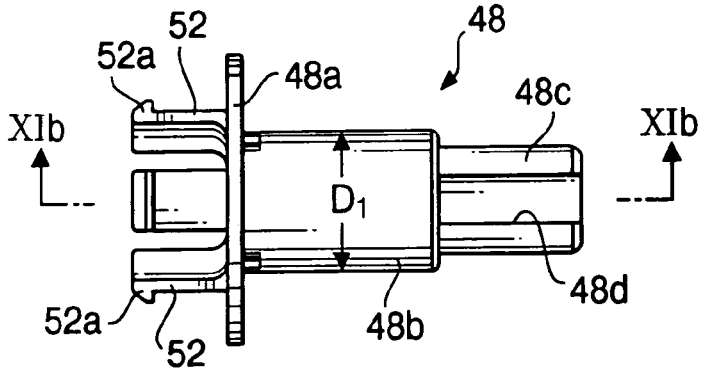
FIG. 11A is a front view showing a shaft member of the takeup-side left spool of FIG. 9.
Figure 11B:
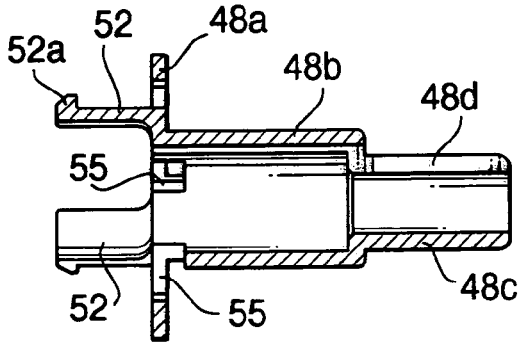
FIG. 11B is a cross-sectional view of the shaft member taken along the line XIb—XIb of FIG. 11A.
Figure 11C:
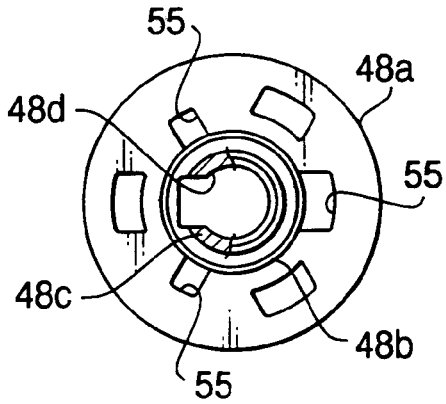
FIG. 11C is a right side view of the shaft member.
Figure 13A:
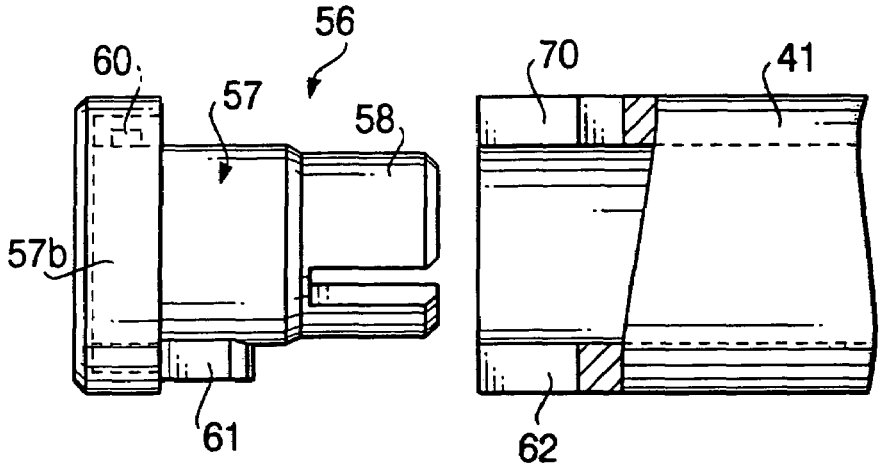
FIG. 13A shows the inter mediate connector and the core tube.
Figure 13B:
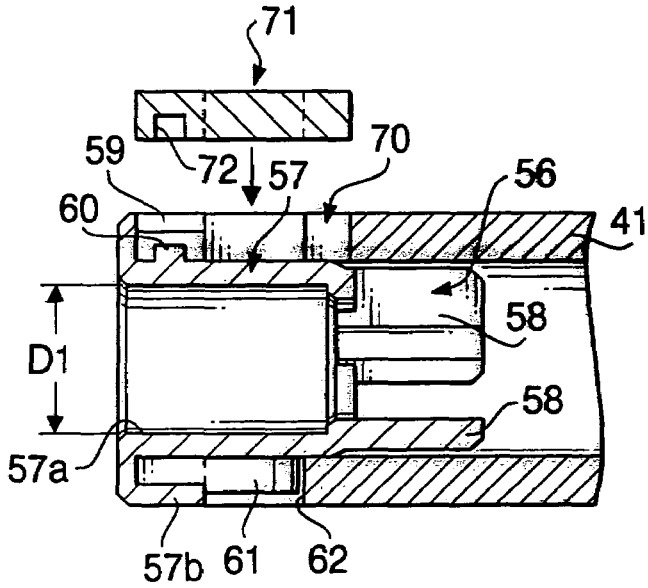
FIG. 13B is a cross sectional view of he inter mediate connector and the core tube showing a situation where the intermediate connector is inserted into the core tube.
Figure 13C:
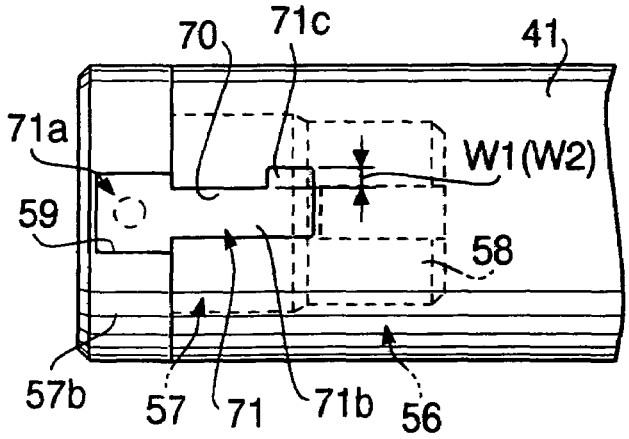
FIG. 13C is an outward appearance of the inter mediate connector and the core tube showing the situation where the intermediate connector is inserted into the core tube.

An inner peripheral surface 57*a* of a base end portion of the cylindrical base 57 is configured to have a diameter D1 which is substantially equal to a diameter of the sleeve base 48*b* of the shaft member 48 so that the sleeve base 48 is rotatably fitted into the inner peripheral surface 57*a* (see FIGS. 11A, 12A and 13B). The guide portion 48*c* of the shaft member 48 is rotatably fitted into inner peripheral surfaces of the three cam segments 58 of the intermediate connector 56 (see FIGS. 14A and 14B).

As described above, the engagement pawl 51*a* of the resilient member 51 protrudes outwardly in the radial direction from the guide portion 48*c*. Therefore, only when the shaft member 48 (i.e., the engagement pawl 51*a*) rotates in an unwinding direction (i.e., a direction opposite to a direction indicated by an arrow M shown in FIG. 15), the engagement pawl 51*a* slidingly moves on the inner pheripheral surface of the can segments 58 against resilient force of the resilient member 51. Therefore, in this case, the intermediate connector 56 stays still without rotating even though the resilient member 51 (i.e., the shaft member 48) rotates.

On the other hand, when the resilient member 51 rotates in a winding direction (i.e., the direction indicated by the arrow M in FIG. 15), the engagement pawl 51*a* is brought in abutment with one of short surfaces of the cam segments 58 and in engagement with one of spaces formed between adjacent two cam segments 58. In this case, the intermediate connector 56 rotates together with the rotation of the shaft member 48.

The intermediate connector 56 has a maximum diameter portion 57*b* having a diameter equal to an outside diameter of the core tube 41. The maximum diameter portion 57*b* has a maximum diameter of the intermediate connector 56. The maximum diameter portion 57*b* is formed with a recessed portion 59 in which one end portion of the male engagement member 71 can be fitted. The recessed portion 59 has a width W0in a circumferential direction, and the male engagement member 71 also has a base 71*a* having a width W0. Further, the recessed portion 59 is integrally formed with a pin 60, which protrudes radially to be inserted into an insertion hole 72 formed on an inner peripheral surface of the base 71*a* of the male engagement member 71. By inserting the male engagement member 71 into the recessed portion 60, the pin 60 of the maximum diameter portion 57*b* is also inserted into the insertion hole 72 of the male engagement member 71. With this structure, the male engagement member 71 can firmly engage with intermediate connector 56.

At a left end portion of the core tube 41, the female engagement portion 70 is formed. The female engagement portion 70 includes an opening 70*a* having a width of W0.

The cylindrical base 57 is formed with two protruding segments 61 and 61 located on an opposed side with respect to the recessed portion 59. An interval Wp between the protruding segments 61 and 61 is larger than the width W0 of the opening 70*a* of the core tube 41. Therefore, the protruding segments 61 and 61 can not be inserted into the openings 70*a* of the core tube 41. Although in this embodiment, two protruding segments are formed, the number of protruding members may be different from two.

The male engagement member 71 has the base 71*a*, an arm portion 71*b* integrally provided to the base 71*a*, and an engagement pawl 71*c*. The engagement pawl 71*c* is formed at an end portion of the arm portion 71*b* oppositely to the base 71, and extends in the circumferential direction of the core tube 41. The arm portion 71*b* and the engagement pawl 71*c* have a form of a letter L so that they brought into firm engagement with the opening 70*a* and the catching notch 70*c* of the female engagement portion 70 (see FIGS. 12A and 13C).

Preferably, a protruding amount W1 of the engagement pawl 71*c* from the arm portion 71*b* is larger than or equal to 1.5 mm, and W1<W2 holds (W2 is a width of the catching notch 70*c* in the circumferential direction of the core tube 41).

The pin 60 formed on the recessed portion 59 and the insertion hole 72 formed on the male engagement member 71 serves as an fixing system for fixing the male engagement member 71 to the intermediate connector 56. Although in this embodiment the pin 60 is provided on the recessed portion 59 and the insertion hole is formed on the male engagement member 71, a pin may be alternatively formed on the base 71*a* of the male engagement member 71 and a insertion hole may be formed on the recessed portion 59 of the intermediate connector 56.

Figure 12B:
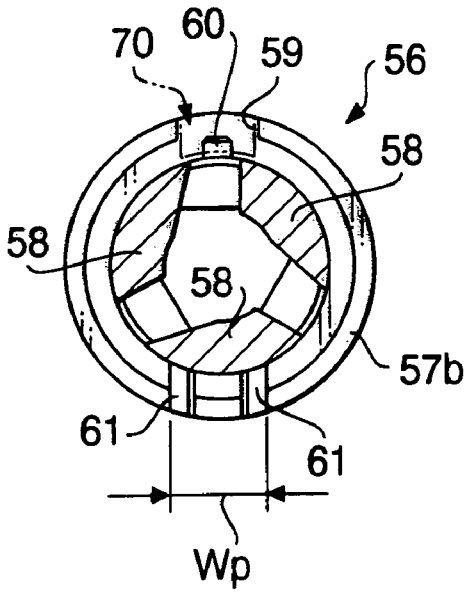
FIG. 12B is a cross-sectional view of the intermediate connector taken along the line XIIb—XIIb of Fis. 12A.

Preferably, as shown in FIGS. 12A and 12B, the male engagement member 71 has an outer peripheral surface whose cross section is configured to be a part of a circular arc having a radius of curvature equal to that of an outer peripheral surface of the core tube 41. With this structure, in a situation where the male engagement member 71 is fitted into the female engagement portion 70 of the core tube 41 fitted with the intermediate connector 56, an engaged portion of the core tube 41, the male engagement member 71 and the intermediate connector forms a cylindrical shape.

In the above mentioned configuration, the intermediate connector 56 is attached to the left end portion of the core tube 41 in a following manner.

First, the cylindrical base 57 of the intermediate connector 56 is inserted into an inner peripheral surface of the left end portion of the core tube 41 while the protruding segments 61 are fitted into the cutout groove 62 formed on the left end portion of the core tube 41 (see FIGS. 13A and 13B). In this case, since the interval Wp of the protruding segments 61 is larger than the width W0of the opening 70*a*, the protruding segments 61 can only be inserted into the cutout groove 60, and cannot be inserted into the opening 70*a*.

With this configuration, alignment of positions of the female engagement portion 70 and the recessed portion 59 in the circumferential direction can be simply and reliably attained by inserting the protruding segments 61 to the cutout groove 62. Further, even if the engage member 71 accidentally disengages from the female engagement portion 70 of the core tube 41 due to, for example, breaking of the pin 60, transmission of the torque acting on the transmission gear 47 to the core tube 41 can be maintained because the protruding segment 61 of the intermediate connector engages with the cutout groove 62 of the core tube 41.

After the cylindrical base 57 of the intermediate connector 56 is inserted into the inner peripheral surface of the left end portion of the core tube 41, the arm portion 71*b* and the engagement pawl 71*c* of the male engagement member 71 are fitted into the female engagement portion 70 (the opening 70*a* and the catching notch 70*c*) from the radially outer side of the female engagement portion 70. Also, in this case, the base 71*a* of the male engagement member 71 is fitted into the recessed portion 59 of the intermediate connector 56.

More specifically, by inserting the base 71*a* of the male engagement member 71 into the recessed portion 59, the pin 60 of the recessed portion 59 is pressed into the insertion hole 72 of the male engagement member 71. Therefore, the male engagement member 71 is firmly fixed to the intermediate connector 56. consequently, it is prevented that the intermediate connector 56 disengages from the core tube 41 in the axial direction of the core tube 41.

As mentioned below, the male engagement member 71 has the function similar to that of the protruding segments 61. In a situation where the base 71*a* of the male engagement member 71 is fitted into the recessed portion 59 of the intermediate connector 59, the longitudinal direction of the arm portion 71*b* of the male engagement member 71 is defined. That is, the arm portion 71*b* is directed to be parallel with the axial direction of the core tube 41.

Further, by fitting the arm portion 71*b* and the engagement pawl 71*c* of the male engagement member 71 into the female engagement portion 70 (the opening 70*a* and the catching notch 70*c*) of the core tube 41, the rotational movement of the intermediate connector 56 relative to the core tube 41 is inhibited. That is, the intermediate connector 56 rotates together with the core tube 41. With this configuration, the driving torque transmitted from the inside of the facsimile machine 1 to the transmission gear 47 is reliably transmitted to the core tube 41 (i.e., the takeup sheet spool 26).

The engagement pawl 71*c* of the male engagement member 71 extends in the circumferential direction of the core tube 41 (i.e., the direction intersecting with the axial direction of the core tube 41), and the catching notch 70*c* also extends in the circumferential direction. Therefore, after the arm portion 71*b* and the engagement pawl 71*c* of the male engagement member 71 are inserted into the engagement hole 70 of the core tube 41, the core tube 41 can not rotate relative to the male engagement member 71.

In addition, the base 71*a* of the male engagement member 71 is firmly fixed to the recessed portion 59 of the intermediate connector 56 so that the arm portion 71*b* of the male engagement member 71 can not be moved in the circumferential direction of the core tube 41. Accordingly, the intermediate connector 56 and the core tube 41 are brought into locking engagement with each other in the axial direction of the core tube 41. That is, in this situation the intermediate connector 56 can not be pulled out from the core tube 41.

As described above, the ink sheet cartridge 20 according to the embodiment needs to use the intermediate connector 56. Therefore, it is prevented that a non-regular ink sheet provided by a non-regular vendor, which is different from a regular vendor of the ink sheet cartridge 20, is erroneously attached to the ink sheet cartridge 20. It is also prevented that quality of the image formed by the facsimile machine 1 is deteriorated due to the use of the non-regular ink sheet.

Preferably, the first rotation member 46, the shaft member 48, the intermediate connector 56 and the male engagement member 71 are made of flexible material such as a synthetic resin.

Next, installation of an exchangeable ink-sheet set onto the cartridge body 30 will be described. The exchangeable ink-sheet set is a set of the supply-side core tube 40, a new ink sheet 21 wounded over the core tube 40, and the takeup-side core tube 41. The intermediate connector 56 is inserted into the core tube 41.

It is preferable that the ink sheet 21 has the width equal to a distance between the outermost end of the maximum diameter portion 57*b* of the intermediate connector 56 attached to the left end of the core tube 41 and the right end of the core tube 41. In this case, the ink sheet is rewound over the core tube 41 completely covers the male engagement member 71 from the outside. Therefore, it is reliably prevented that the male engagement member 71 disengages from the female engagement portion 70 of the core tube 41.

The ink sheet 21 may have such a width that the ink sheet 21 wound over the core tube 41 covers almost all of the male engagement member 71 (e.g., the arm portion 71*b* and the engagement pawl 71*c*). It is also possible in this case to prevent the detachment of the male engagement member 71 from the female engagement portion 70 of the core tube 41.

Next, a leading end of the new ink sheet 21 is attached to the outer peripheral surface of the core tube 41 by an adhesive tape. The first rotation member 46 and the shaft member 48 are unreleasably installed into the shaft hole 50 of the cartridge body 30 in a manner described above to form the left spool 38 (see FIG. 14A).

After the above mentioned preparation is finished, the following installation work is conducted. First, the takeup-side spool 39 is inserted into the right end of the core tube 41, and the supply-side spools 36 and 37 are inserted into the respective ends of the supply-side core tube 40 (see FIG. 8).

Next, the sleeve base 48*b* of the shaft member 48 is inserted into inner peripheral surface 57*a* of the intermediate connector 56. Then, the intermediate connector 56 is rotated relatively to the shaft member 48 so that the engagement pawl 51*a* fits in one of the spaces defined by adjacent two cam segments 58 in a manner described above. Consequently, the shaft member 48 and the intermediate connector 56 are connected to each other such that the intermediate connector 56 rotates together with the shaft member 48. Because only by inserting the sleeve base 48*b* into the inner peripheral surface 57*a*, the engagement pawl 51*a* can be engaged with the cam segments 58, attachment and detachment work can be facilitated.

Next, the spools 36, 37 and 39 are fitted into the respective shaft support grooves 33,33,33 of the cartridge body 33. Then, the core tube 41 is manually rotated in the winding direction M to remove a slack of the ink sheet 21.

When the ink sheet cartridge 20 is accommodated in the accommodating portion 13 of the facsimile machine 1, the left and right side plates 31*a*,31*b* of the cartridge body 20 are held at their predetermined postures. At this time, inner peripheral surfaces of the shafts 44,44 of the spools 37,39 engage with respective shafts (not shown) protruding from one side of the body case 2 of the facsimile machine 1. At the same time, the gear wheel 45 of the spool 36 and the transmission gear 47 of the spool 48 are respectively in meshing engagement with power transmission gears (not shown) provided in the body case 2. Further, inner surfaces of outer sleeve portions of the spool 36 and the spool 38 are engaged with corresponding shafts (not shown) resiliently protruding from another side of the body case 2 of the facsimile machine 1. This arrangement enables the supply sheet spool 25 and the takeup sheet spool 26 to smoothly rotate.

Printing is started upon operation of the control board 29 based on either a printing command inputted from the operation panel 3, a printing command received from an external computer (not shown), or a facsimile data transmitted from other facsimile machine via a public line. once the printing is started, first the sheet supply roller 15 rotates to start supply of the recording sheet 4.

After a sheet sensor (not shown) has detected the leading end of the recording sheet 4, the recording sheet 4 is further carried by a predetermined distance. When the leading end of the recording sheet 4 approaches the platen 17, driving force is transmitted to the platen 17, and also to the gear wheel 45 and the transmission gear 47 of the ink sheet cartridge 20.

Figure 15:
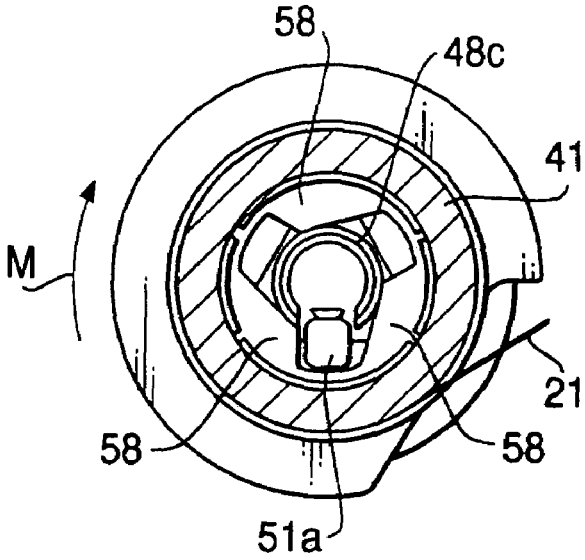
FIG. 15 is a cross-sectional view taken along the line XV—XV of FIG. 14B.

Because the engagement pawl 51*a* of the resilient member 51 has already brought into engagement with the space between the neighboring cam segments 58 of the intermediate connector as shown in FIG. 15, the rotation of the transmission gear 47 is reliably transmitted to the core tube 41. As a result, transportation of the ink sheet 21 is performed concurrently with the transportation of the recording sheet 4, and printing is performed on to the recording sheet 4 by the thermal head 22.

More specifically, when the ink sheet 21 and the recording sheet 4 are nipped at the printing portion between the platen 17 and the thermal head 22, the heat generating resister of the thermal head 22 generates heat in accordance with the print data to perform printing. The heat of the thermal head 22 selectively melts the link on the ink sheet 21, and the melted ink is transferred onto a bottom surface of recording sheet 4, thereby forming an ink image on the recording sheet 4. Then, the ink on the recording sheet 4 is cooled off, and is fixed on the recording sheet 4.

After the printing, only the ink sheet 21 is largely bent downwardly at the top 23*a* of the tension member 23 and separated from the recording sheet 4. then, the ink sheet 21 is carried toward the lower peripheral surface of the takeup sheet spool 26 as shown in FIG. 2. On the other hand, the recording sheet 4 is transported along the upper surface of the partitioning plate 24.

As described above, one end portion of the partitioning plate 24 close to the tension member 23 is bent downwardly. This configuration allows the leading end of the recording sheet 4 to ride over the upper surface of the partitioning plate 24, thereby reliably preventing the recording sheet 4 from being carried downwardly together with the ink sheet 21. In this way, the ink sheet 21 is easily and reliably separated from the recording sheet 4 by the tension member 23 and the partitioning plate 24.

Figure 16:
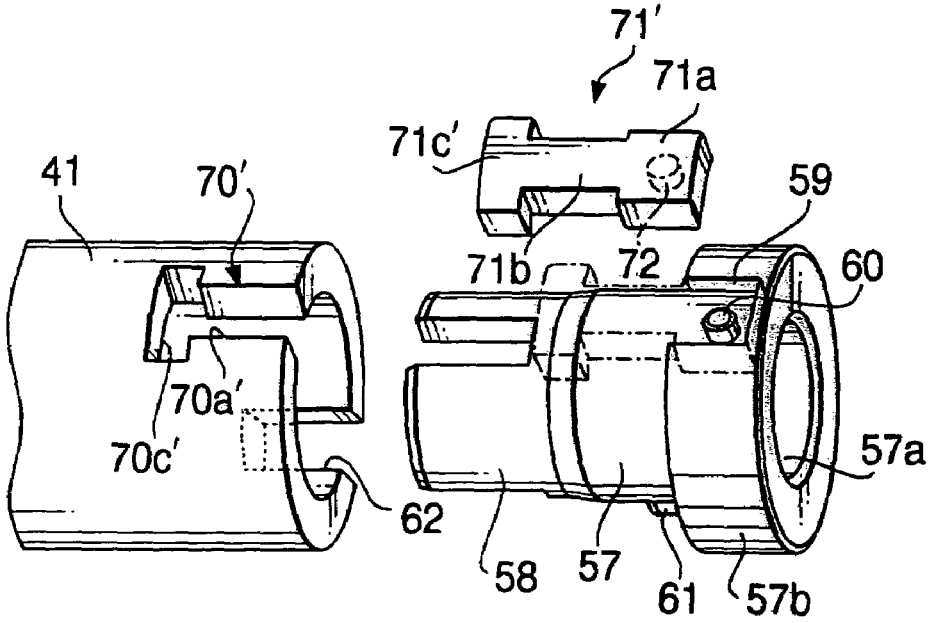
FIG. 16 is a perspective view showing an intermediate connector, a male engagement member and a core tube according to a second embodiment.

Next, a male engagement member and a female engagement portion according to a second embodiment will be described with reference to FIG. 16. In FIG. 16, to elements having the same structures as those shown in FIGS. 1 to 15, the same reference numbers are assigned, and explanations thereof will not be repeated.

As shown in FIG. 16, at the left end portion of the core tube 41, a female engagement portion 70' having a form of a letter T is formed. The female engagement portion 70' is opened toward the left end of the core tube 41. The female engagement portion 70' has an catching notch 70*c'* extending in the circumferential direction of the core tube 41 at an end portion of an opening 70*a'*.

An male engagement member 71' has an engagement pawl 71*c'* extending to cross the longitudinal direction of the arm portion 71*b*. That is, the engagement pawl 71*c'* and the arm portion 71*b* have an outside shape like a letter T. The engagement pawl 71*c'* and the arm portion 71*b* have can be fitted into the catching notch 70*c'* and the opening 70*a'* of the female engagement portion 70'.

By inserting the male engagement member 71' into the female engagement portion 70' from the outside, the male engagement member 71' is brought into locking engagement with the core tube 41. Since the engagement pawl 71*c'* extends to cross the axial direction of the core tube 41 so as to be hooked to the catching notch 70*c'*, and the base 71*a* is fixed to the recessed portion 59 of the intermediate connector 56, the intermediate connector 56 can not be pulled out from the core tube 41 in the axial direction of the core tube 41.

As described in the first and second embodiments, the engagement pawl (71*c*,71*c'*) has the form of a letter L or T. However, the engagement pawl of the male engagement member may have another shape which serves as an anchor-shaped portion to be hooked to a notch formed on the core tube 41. In this case, the notch formed on the core tube 41 has a shape corresponding to the anchor-shaped portion formed on the male engagement member.

Although in the above mentioned embodiment the male engagement member (71,71') is fixed to the recessed portion 59 by press fitting of the pin 60 and the insertion hole 72, another fixing system for fixing the male engagement member to the intermediate connector 56 may be employed. For example, the male engagement member may be fixed to the intermediate connector 56 by fusion boding (welding) using a heating platen, ultrasound, a high-frequency or a low-frequency. Alternatively or additionally, the male engagement member may be fixed to the intermediate connector 56 by adhesive bonding using an adhesive such as a pressure sensitive adhesive, a hot-melt adhesive. The adhesive may be selected in accordance with the type of material of the intermediate connector 56 and/or the male engagement member (71,71').

It is noted that by using the adhesive, the male engagement member can be fixed to the intermediate connector 56 more firmly than the cases of the above mentioned firs and second embodiments.

Figure 17A:
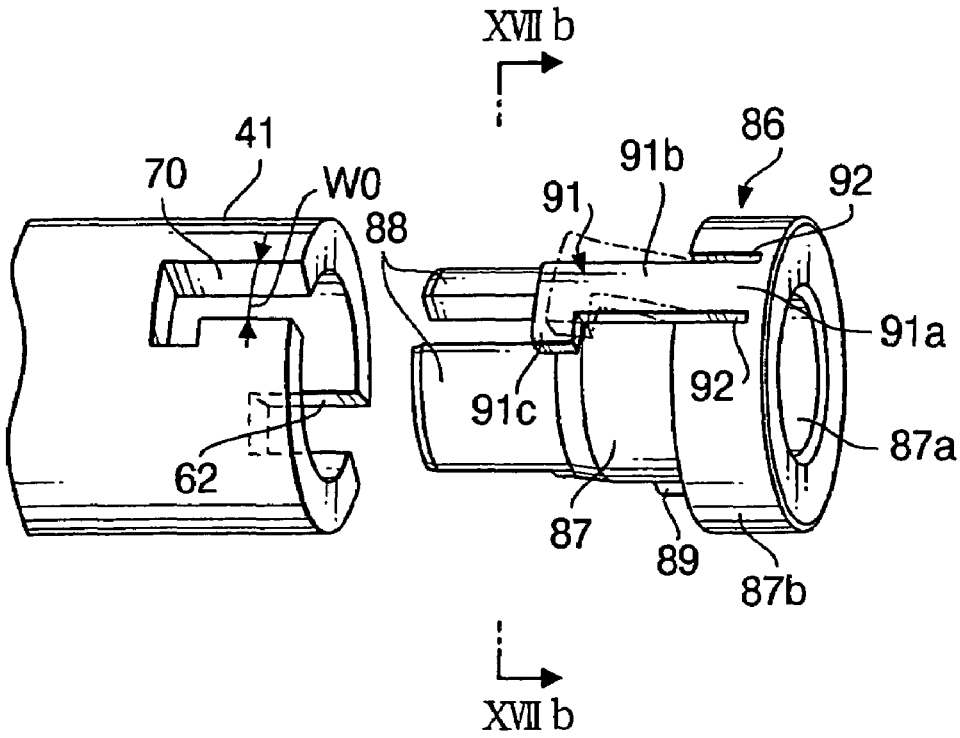
FIG. 17A is a perspective view showing an intermediate connector a male engagement portion and the core tube according to a third embodiment.
Figure 17B:
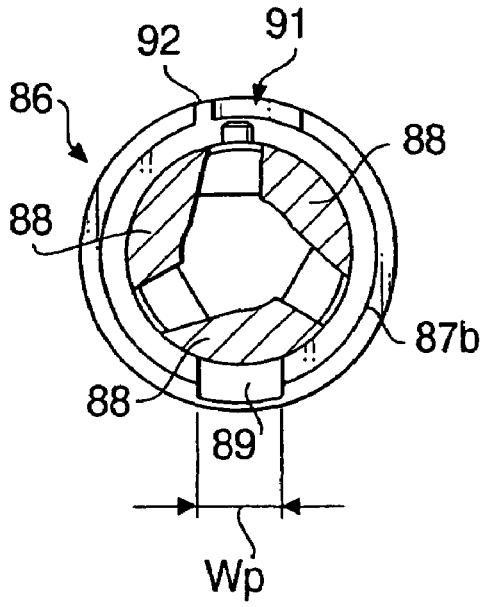
FIG. 17B is a cross-sectional view of the intermediate connector taken along the line XVIIb—XVIIb of FIG. 12A.
Figure 18:
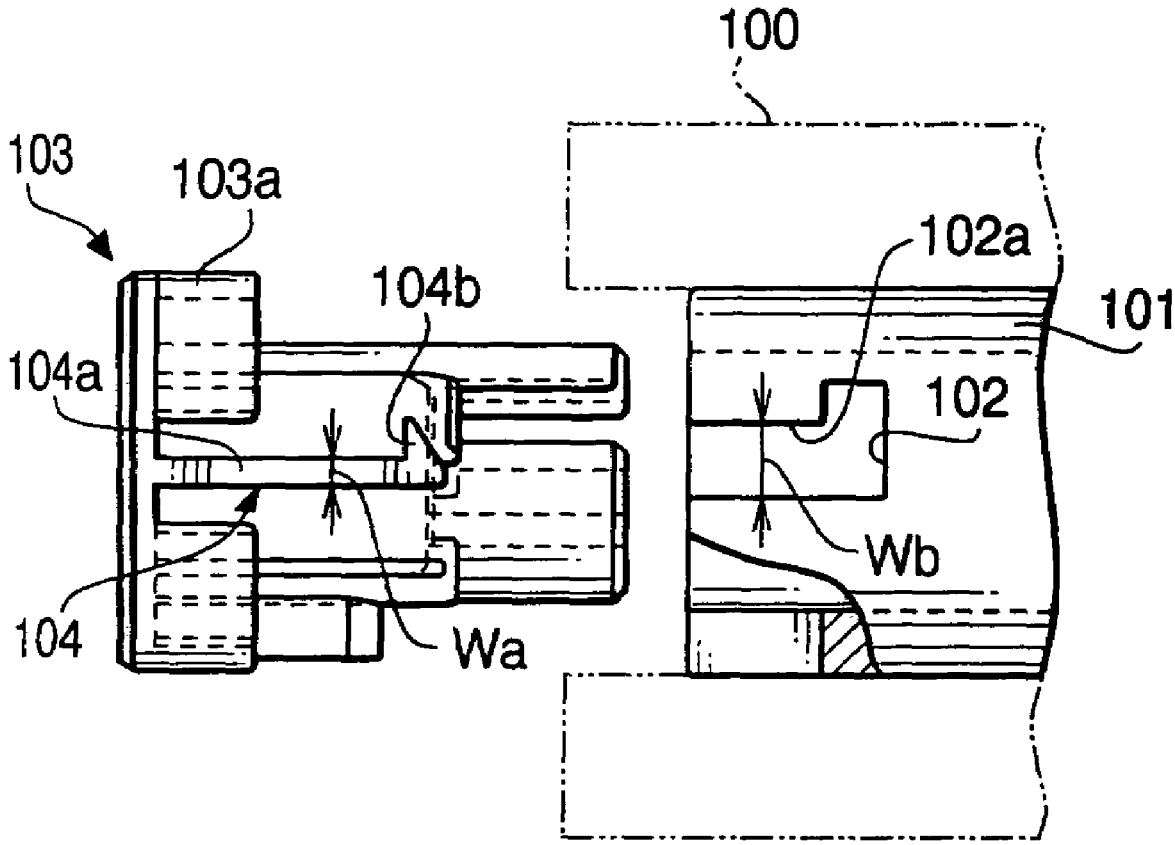
FIG.18 PRIOR ART
FIG. 18 is a front view showing an intermediate connector and an end portion of a core tube of a conventional ink sheet cartridge.

Next, an intermediate connector 86 according a third embodiment will be described with reference to FIGS. 17A and 17B. In FIGS. 17A and 17B, to elements having the same structures as those shown in FIGS. 1 to 15, the same reference numbers are assigned, and explanations thereof will not be repeated.

As shown in FIGS. 17A and 17B, the intermediate connector 86 has a cylindrical base 87. The cylindrical base 87 is integrally formed with three cam segments 88 at its tip portion. The three cam segments 88 are arranged in a circumferential direction of the cylindrical base 87.

An inner peripheral surface 87*a* of a base end portion of the cylindrical base 87 is configured to have a diameter which is substantially equal to a diameter of the sleeve base 48*b* of the shaft member 48 so that the sleeve base 48 is rotatably fitted into the inner peripheral surface 87*a*. The guide portion 48*c* of the shaft member 48 is rotatably fitted into inner peripheral surfaces of the three cam segments 88 of the intermediate connector 86.

The intermediate connector 86 is integrally formed with an engagement portion 91 extending from a maximum diameter portion 87*b* in the axial direction of the intermediate connector 86. The engagement portion 91 has a base 91*a* positioned closely to the maximum diameter portion 87*b*, an arm portion 91*b*, and an engagement pawl 91*c*. The arm portion 91*b* extends in the axial direction. The engagement pawl 91*c* extends, at one end of the arm portion 91*b* opposite to the base 91*a*, to cross the longitudinal direction of the arm portion 91*b*.

The engagement portion 92 has a form of a letter L so that the engagement portion 91 can be fitted into the female engagement portion 70 which also has the form of the letter L.

The engagement portion 91 is formed to be a thin plate so that it resiliently deforms in the radial direction of the intermediate connector 86 (see FIG. 17A). It is preferable that the thickness of the engagement portion 91 (i.e., the thin plate) is about 1 mm when the engagement portion 91 is made of ABS (acrylonitrile butadiene styrene) resins.

It is not necessary that the entire engagement portion 91 is formed to be the thin plate. For example, the engagement portion 91 may have a configuration in which a portion of the arm portion 91*b* is formed as a thin portion which allows the engagement portion 91 to be resiliently deformed in the radial direction.

The maximum diameter portion 87*b* of the intermediate connector 86 is formed with two slits at both sides of the base 91*a* of the engagement portion 91 so that the engagement portion 91 can be resiliently deformed in the radial direction relatively easily.

The cylindrical base 87 is formed with two protruding segments 89 and 89 located on an opposed side with respect to the engagement portion 91. As shown in FIG. 17B, an interval Wp' between the protruding segments 89 and 89 is larger than the width W0 of the opening 70*a* of the core tube 41.

In the above mentioned configuration, the intermediate connector 86 is fitted into the left end portion of the core tube 41 in the following manner.

First, the cylindrical base 87 of the intermediate connector 86 is inserted into the left end portion of the core tube 41 while the engagement portion 91 is deformed outwardly in the radial direction by a finger of a worker (see FIG. 17A in which the deformation of the engagement portion 91 is indicated by a chain line).

Next, the finger of the worker is removed form the engagement portion 91 so that the arm portion 91*b* and the engagement pawl 91*c* of the engagement portion 91 are fitted into the female engagement portion 70 by restoring force which acts on the engagement portion 91 in an inward direction. as a result, the intermediate connector engages with the core tube 41.

The engagement pawl 91*c* of the engagement portion91 extends in the circumferential direction of the core tube 41 (i.e., the direction intersecting with the axial direction of the core tube 41), and the catching notch 70*c* also extends in the circumferential direction. Therefore, after the arm portion 91*b* and the engagement pawl 91*c* of the engagement portion 91 are inserted into the engagement hole 70 of the core tube 41, the core tube 41 can not rotate relative to the engagement portion 91.

In addition, since the base 91*a* of the engagement portion 91 is integrally formed with the intermediate connector 86, the arm portion 71*b* of the engagement portion 91 can not be moved in the circumferential direction of the core tube 41. Accordingly, the intermediate connector 86 and the core tube 41 are brought into locking engagement with each other in the axial direction of the core tube 41. That is, in this situation the intermediate connector 86 can not be pulled out from the core tube 41.

Although in this embodiment the engagement portion 91 has the form of a letter L, the engagement portion 911 may have another shape (e.g., a shape of a letter L) which serves as an anchor-shaped portion to be hooked to a notch formed on the core tube 41.

Although in the above mentioned configurations of the ink sheet cartridge and the exchangeable ink sheet set are applied to the facsimile machine, the configurations of the ink sheet cartridge and the exchangeable ink sheet set according to the embodiments can also be applied to various types of image forming devices such as a printer, a copying machine or a multi-function device.

In the above mentioned embodiment, the intermediate connector is interposed between the left spool 38 and the left end of the core tube 41. However, the intermediate connector may be located between one of the spools 36, 37 and 39 and the corresponding end portion of core tubes 40 or 41. Alternatively, a plurality of intermediate connectors may be provided at the end portions of the core tube 40 and 41.

In the above mentioned embodiments, one male engagement member (or one male engagement portion) is provided to connect the intermediate connector to the end portion of the core tube. A plurality of male engagement members (or male engagement portions) may be provided to connect the intermediate connector to the end portion of the core tube.

The present disclosure relates to the subject matter contained in Japanese Patent Application No. 2003-341372, filed on Sep. 30, 2003, which is expressly incorporated herein by reference in its entirety.

What is claimed is:

1. An ink sheet cartridge mountable on an image forming device, comprising:

at least one core tube;

spools detachably attached to end portions of the at least one core tube, respectively, so that the at least one core tube is rotatably supported in the ink sheet cartridge via the spools;

at least one intermediate connector that is interposed between at least one of the spools and corresponding one end portion of the at least one core tube, the corresponding one end portion at which the at least one intermediate connector is interposed being formed with a female engagement portion; and a male engagement member that is fitted into the female engagement portion from an outside of the at least one core tube so that the at least one intermediate connector is engaged with the at least one core tube.

2. The ink sheet cartridge according to claim 1, wherein the at least one intermediate connector has a recessed portion, the male engagement member being fixed to the recessed portion of the at least one intermediate connector by press fitting.

3. The ink sheet cartridge according to claim 2, wherein one of the male engagement member and the recessed portion of the at least one intermediate connector has a pin, and the other of the male engagement member and the recessed portion of the at least one intermediate connector has a insertion hole, wherein the male engagement member is fixed to the recessed portion of the at least one intermediate connector by pressing the pin into the insertion hole.

4. The ink sheet cartridge according to claim 1, wherein the at least one intermediate connector has a recessed portion, the male engagement member being fixed to the recessed portion of the at least one intermediate connector by adhesive bonding.

5. The ink sheet cartridge according to claim 1, wherein the at least one intermediate connector has a cylindrical form, wherein the male engagement member includes:

a base that is fixed to the at least one intermediate connector;

an arm portion extending from the base; and an engagement pawl formed at an end of the arm portion opposite to the base, the engagement pawl extending to cross a longitudinal direction of the arm portion, wherein the female engagement portion includes:

an opening extending in an axial direction of the at least one core tube; and a catching portion extending in a circumferential direction of the at least one core tube, wherein the arm portion and the engagement pawl of the male engagement member are fitted into the opening and the catching portion of the female engagement portion, respectively.

6. The ink sheet cartridge according to claim 5, wherein the arm portion of the male engagement member and the opening of the female engagement portion have sizes substantially equal to each other in the circumferential direction, wherein movement of the male engagement member is restricted to a radial direction of the at least one core tube in a situation where the male engagement member has been fitted into the female engagement portion.

7. The ink sheet cartridge according to claim 5, wherein the arm portion and the engagement pawl of the male engagement member are formed in a shape of a letter L, wherein the opening and the catching portion of the female engagement portion are formed in a shape of a letter L.

8. The ink sheet cartridge according to claim 5, wherein the arm portion and the engagement pawl of the male engagement member are formed in a shape a letter T, wherein the opening and the catching portion of the female engagement portion are formed in a shape of a letter T.

9. The ink sheet cartridge according to claim 5, wherein the at least one intermediate connector has:

a maximum diameter portion having a maximum diameter of the at least one intermediate connector, a diameter of the maximum diameter portion being equal to an outer peripheral surface of the at least one core tube; and a recessed portion formed at the maximum diameter portion, wherein the base of the male engagement member is fitted into the recessed portion of the at least one intermediate connector.

10. The ink sheet cartridge according to claim 9, wherein the male engagement member has an outer peripheral surface whose cross section is configured to be a part of a circular arc having a radius of curvature equal to that of the outer peripheral surface of the at least one core tube.

11. The ink sheet cartridge according to claim 5, wherein the one of the end portions at which the at least one intermediate connector is interposed is formed with a cutout groove extending from the one of the end portions at which the at least one intermediate connector is interposed, in an axial direction of the at least one core tube, wherein the at least one intermediate connector has a protruding segment portion protruding outwardly in a radial direction of the at least one intermediate connector, the protruding segment portion of the at least one intermediate connector being fitted into the cutout groove of the at least one core tube, wherein a size of the protruding segment portion in a circumferential direction of the at least one intermediate connector is larger than a width of the opening of the female engagement portion.

12. The ink sheet cartridge according to claim 1, wherein an ink sheet is wound on the at least one core tube such that the ink sheet covers at least a portion of the male engagement member.

13. The ink sheet cartridge according to claim 1, wherein the at least one intermediate connector has a cylindrical form and is made of flexible material, wherein the male engagement member is integrally formed with the at least one intermediate connector, the male engagement member resiliently deforming in a radial direction of the at least one intermediate connector so as to engage with and to disengage from the female engagement portion, wherein the male engagement member being fitted into the female engagement portion by restoring force thereof acting inwardly in the radial direction.

14. The ink sheet cartridge according to claim 13, wherein the at least one intermediate connector has a maximum diameter portion having a maximum diameter of the at least one intermediate connector, wherein the male engagement member of the at least one intermediate connector includes:

an arm portion extending from the maximum diameter portion of the at least one intermediate connector; and an engagement pawl formed at an end of the arm portion, the engagement pawl extending to cross a longitudinal direction of the arm portion, wherein the arm portion is formed to be a thin plate so as to have flexibility in the radial direction.

15. The ink sheet cartridge according to claim 13, wherein the at least one intermediate connector has a maximum diameter portion having a maximum diameter of the at least one intermediate connector, wherein the male engagement member of the at least one intermediate connector includes:

an arm portion extending from the maximum diameter portion of the at least one intermediate connector; and an engagement pawl formed at an end of the arm portion, the engagement pawl extending to cross a longitudinal direction of the arm portion, wherein slits are formed on the maximum diameter portion of the at least one intermediate connector at both sides of the arm portion of the male engagement member.

16. The ink sheet cartridge according to claim 14, wherein the female engagement portion includes:

an opening extending in an axial direction the at least one core tube; and a catching portion extending in a circumferential direction of the at least one core tube, wherein the arm portion and the engagement pawl of the male engagement member are fitted into the opening and the catching portion of the female engagement portion, respectively.

17. The ink sheet cartridge according to claim 14, wherein a diameter of the maximum diameter portion is equal to an outer peripheral surface of the at least one core tube.

18. The ink sheet cartridge according to claim 16, wherein the one of the end portions at which the at least one intermediate connector is interposed is formed with a cutout groove extending from the one of the end portions at which the at least one intermediate connector is interposed, in an axial direction of the at least one core tube, wherein the at least one intermediate connector has a protruding segment portion protruding outwardly in a radial direction of the at least one intermediate connector, the protruding segment portion of the at least one intermediate connector being fitted into the cutout groove of the at least one core tube, wherein a size of the protruding segment portion in a circumferential direction of the at least one intermediate connector is larger than a width of the opening of the female engagement portion.

19. The ink sheet cartridge according to claim 13, wherein the at least one intermediate connector is made of a synthetic resin.

20. An exchangeable ink sheet set used with at least one intermediate connector, a male engagement member and spools in an ink sheet cartridge, comprising:

an ink sheet having a predetermined width; and a plurality of core tubes including a supply-side core tube mountable on the ink sheet cartridge at a supply side and a takeup-side core tube mountable on the ink sheet cartridge at a takeup side;

the spools being detachably attached to end portions of the plurality of core tubes, respectively, so that the plurality of core tubes are rotatably mounted on the ink sheet cartridge via the spools;

the at least one intermediate connector being interposed between at least one of the spools and corresponding one of the end portions of at least one core tube of the plurality of core tubes, the corresponding one of the end portions at which the at least one intermediate connector is interposed being formed with a female engagement portion, the male engagement member being fitted into the female engagement portion from an outside of the at least one core tube so that the at least one intermediate connector is engaged with the at least one core tube.

21. The exchangeable ink sheet set according to claim 20, wherein the at least one intermediate connector has a cylindrical form and is made of flexible material, wherein the male engagement member is integrally formed with the at least one intermediate connector, the male engagement member resiliently deforming in a radial direction of the at least one intermediate connector so as to engage with and to disengage from the female engagement portion, wherein the male engagement member being fitted into the female engagement portion by restoring force thereof acting inwardly in the radial direction.

* * * * *